United States Patent [19]

Newbill

[11] Patent Number: 4,541,633

[45] Date of Patent: Sep. 17, 1985

[54] GAME WITH TWO SEPARATED ELECTRICALLY-CONNECTED BOARDS

[76] Inventor: Leston L. Newbill, 927 N. Erringer Rd., Simi Valley, Calif. 93065

[21] Appl. No.: 417,836

[22] Filed: Sep. 14, 1982

[51] Int. Cl.[4] ..... A63F 3/02

[52] U.S. Cl. ..... 273/238; 273/1 E; 273/260

[58] Field of Search ..... 273/1 E, 85 G, 237, 273/260, 238, 288, DIG. 28

[56] References Cited

U.S. PATENT DOCUMENTS

| | | | |
|---|---|---|---|
| 3,878,675 | 4/1975 | Prociuk | 273/237 |
| 3,887,189 | 6/1975 | Dawes | 273/238 |
| 3,888,491 | 6/1975 | Bernard et al. | 273/237 |
| 4,082,285 | 4/1978 | Bathurst | 273/237 |
| 4,235,442 | 11/1980 | Nelson | 273/237 |
| 4,342,454 | 8/1982 | Baer et al. | 273/85 G |
| 4,391,447 | 7/1983 | Dudley | 273/238 |
| 4,398,720 | 1/1981 | Jones et al. | 273/238 |

*Primary Examiner*—Richard C. Pinkham
*Assistant Examiner*—Mary Ann Stoll Lastova

[57] ABSTRACT

An electronic strategy game featuring playing fields comprising two chess-like boards each of which may contain 64 squares and be separated from each other by a partition of suitable size to conceal the moves made by each player and two sets of chessmen positioned on each board. Each square has a sensor embedded in its base arranged to transmit to an electronic processing unit the location of all chessmen on the game boards. The electronic processing unit determines the game status, controls announcements to the players, and includes logic whereby the position of all chessmen are maintained in a memory and moves are regulated in accordance with predetermined rules such as the rules of chess. Requests for additional status information and the selection of optional game features are transmitted to the electronic processing unit via two control panels located one on each game board. The electronic game includes features not normally available to players utilizing a human referee. These features include "timed games" where each player has a limited amount of time to execute his next move and a replay feature where the previous game can be automatically replayed to allow the players to determine whether their analysis of the battlefield conditions were correct.

24 Claims, 8 Drawing Figures

(READ)
154
COMP
152
156
REF
151
150
206
+V
301
148
304
303
302
147
146
MULTIPLEXER
(SEL)
160
128
BUF DATA BUS
161
159
120
(SEL)
REGISTER
MULTIPLEXER
(WRITE)
162
158
144 (TYPICAL, 64 PLACES)
145

(READ)
170
COMP
172
174
REF
206
+V
168
169
166
MULTIPLEXER
(SEL)
178
BUF DATA BUS
128
179
177
180
(SEL)
MULTIPLEXER
REGISTER
(WRITE)
182
176
164 (TYPICAL, 64 PLACES)

GAME WITH TWO SEPARATED ELECTRICALLY-CONNECTED BOARDS

BACKGROUND OF THE INVENTION

1. Field of the Invention

This invention pertains generally to games and in particular to mechanical and electronic chess-like games wherein two players compete under the supervision of a referee.

2. Description of the Prior Art

The present minaturized electronic revolution has been responsible for the appearance of numerous portable chess playing games whereas a single player competes with the electronic device in a game of chess (such as is described on pages 84 through 90 of "BYTE" magazine for December 1978, pages 110 through 115 of "BYTE" for January 1979 and pages 34 through 54 of "BYTE" for Sepember 1979).

Computer programs could be written to be executed on a general purpose computer to referee Kriegspiel games, but such computer systems require an expensive central processing unit, costly display apparatus (such as cathode ray tubes) and expensive input devices (such as terminals) for the operation of the game. Furthermore, the computer system, as commonly used for the game of chess does not represent the game pieces as 3 dimensional figures but instead as 2 dimensional figures on a cathode ray tube. Such general purpose computer systems have no provision for the detection of 3 dimensional game pieces so as to allow the players to conviently input moves by actually moving a game piece on the game board. Instead a player must input moves via a terminal keyboard or cathode ray tube probe.

However, the prior art does not disclose any portable electronic game to referee the game of Kriegspiel that consists of a relatively inexpensive central processing unit, together with input and output apparatus, and which allows the use and detection of actual 3 dimensional game pieces.

OBJECTS AND SUMMARY OF THE INVENTION

Accordingly, it is the object of the present invention to provide a portable electronic system that would replace the human referee in Kriegspiel (chess-like strategy game), thereby making the game playable without the presence of a human referee. A secondary object of the invention is to provide a faster and error-free referee, so that the speed of the game is limited only by the players, and so that games never have to be abandoned because of missed calls by the referee.

It is another object of the present invention to provide a portable game reguiring relatively inexpensive electronic components to perform the central processing and input/output functions.

The invention which satisfies the above and other objects (as will become more clear from the appended drawings and detailed description) may be briefly summarized as a portable game featuring playing fields consisting of two adjacent chess-like boards each containing squares or rectangles in matrix separated to conceal the moves made by each player from the other player, with two sets of men positioned on each board. Each square or rectangle has a sensor imbedded in its base arranged to transmit to the electronic processing unit the location of all men on both game boards.

The electronic processing unit determines the status of the game and makes announcements to the players and includes logic whereby the position of men are maintained in a memory. Requests for additional status information and the selection of optional game rules and features are transmitted to the electronic processing unit via two control panels located on each game board.

Other objects and advantages of the invention will be apparent from a reading of the following specifications and claims taken with the drawings.

BRIEF DESCRIPTION OF THE DRAWINGS

For a more thorough understanding of the nature of the present invention and how if may be best practiced by one skilled in the art, reference is made to the following detailed description and the appended figures in which.

DETAILED DESCRIPTION OF THE PREFERRED EMBODIMENTS

Figure 1:
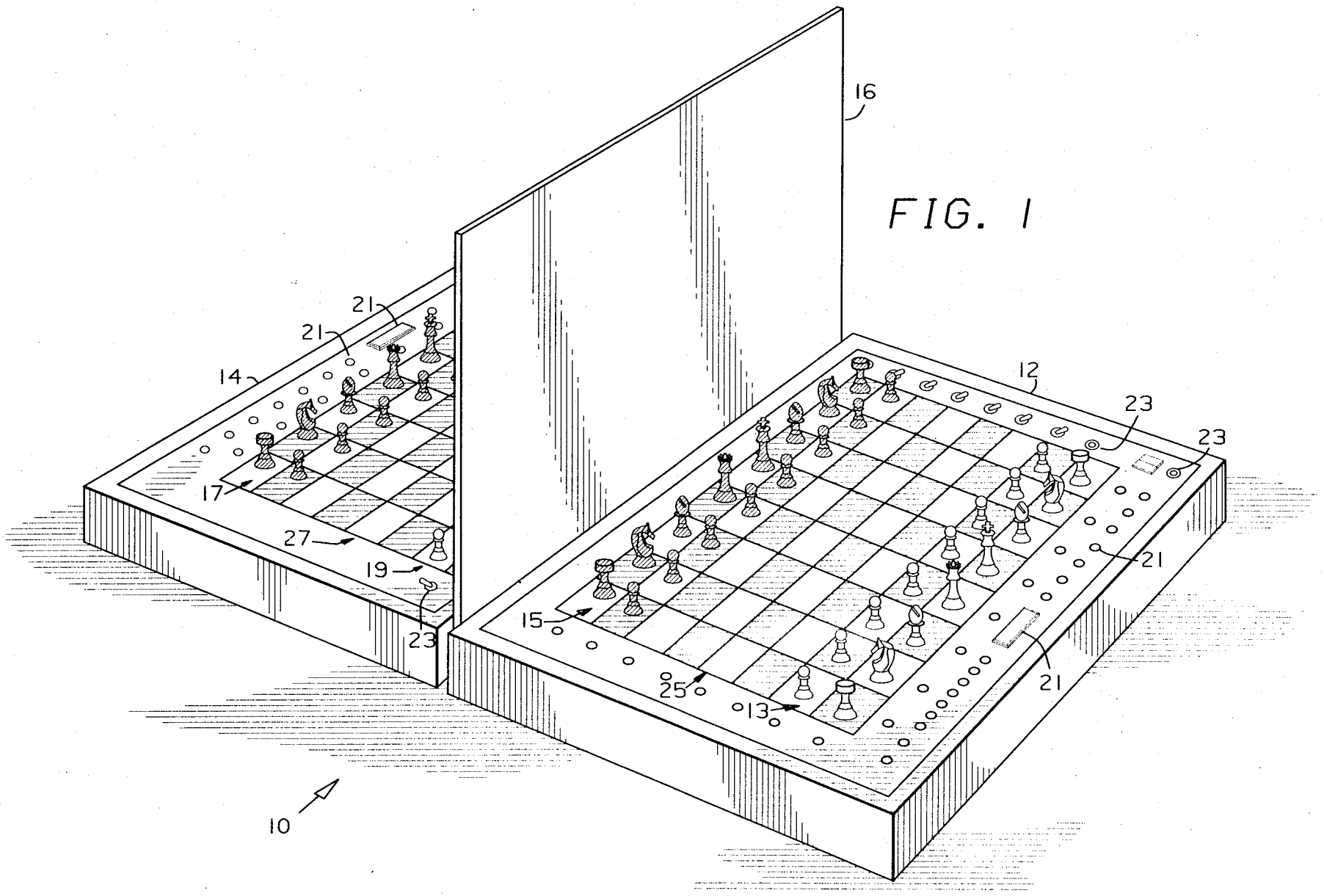
FIG. 1 shows a perspective view of a portable embodiment of an electronic Kriegspiel game in accordance with the present invention as it is percieved by the players.

To provide an unambiguous working vocabulary, the following definitions are provided:

GAME: Refers to the game of Kriegspiel and variations thereof as described herein.

GAME PIECES: Any and all chessmen used in the game. The "game pieces" are moved according to the rules of chess.

BOARD: The rectangular area where the chessmen are positioned and the output displays and input switches are located. (One board for the white player and one for the black player).

WHITE SIDE: Refers to the white player's board.

BLACK SIDE: Refers to the black player's board.

PLAYING FIELD OR PLAYING FIELD MATRIX: The region on the white and black boards consisting of 64 rectangular regions in an 8 by 8 matrix where the chessmen are positioned. (Similar to the playing field of a normal chessboard).

PLAYERS: The two individuals, white and black, as the terms are conventionally used in chess, competing in the game.

PARTITION: A barrier positioned between the white and black boards to conceal the moves made by each player from the other player.

PIECE: A chessman other than a pawn or king (queen, rook, bishop or knight).

SIDE TO MOVE NEXT: Refers to the white and black game boards where the next move is to take place.

MATRIX LEDS: Refers to 8 row and 8 column leds (light emitting diode) located on each board that define the location of any one of the 64 rectangular areas that comprises the 8 by 8 playing field matrix.

WHITE MATRIX LEDS: Refers to 8 row and 8 column matrix leds (a total of 16) located on the white board.

BLACK MATRIX LEDS: Refers to 8 row and 8 column matrix leds (a total of 16) located on the black board.

CHECK DIRECTION: A diagonal left check (up and to the left,\) and a diagonal right check (up and to the right,/) is defined as a check in the diagonal direction of the board as determined by a line connecting the king (the one in check) and the checking chessman. A diagonal short (S) or diagonal long (L) check is defined by the following rule: The total number of rectangles are counted along the diagonal passing through the king (the one in check) and the checking chessman and extending in both directions to the edge of the playing field. This total number of rectangles in the check direction is compared to the number of rectangles on the diagonal passing through the checked king and at right angle to the first diagonal and extending in both directions to the edge of the playing field. If the former number is greater than the latter, the announcement is long (L) diagonal check and if the number is smaller the announcement is short (S) diagonal check. (Will be more clear hereinafter with reference to example illustrated in FIG. 3).

A vertical (V) check is defined as a check wherein a line drawn between the checked king and checking chessman lies in a direction parallel to the player's line of sight.

A horizontal (H) check is defined as a check wherein a line drawn between the checked king and checking chessman lies in a direction perpendicular to the player's line of sight.

A knight check is defined as a check wherein the checking chesspiece is a knight.

PAWN TRY: Refers to all possible captures that can be made by pawns. A pawn try exists if one or more pawns are in position to capture opposing chessmen.

ADVANCE MOVE: A move initiated while it's still one's opponent's turn to move.

PAWN PROMOTION: Refers to a pawn being promoted to a queen upon reaching the 8th rank.

NON-TIMED GAME: A game wherein each player has an unlimited amount of time to compete against his opponent.

FIXED TIMED GAME: A timed game wherein each player has a fixed amount of time to compete against his opponent. The amount of time is selected at the beginning of the and running out of time results in loss of the game.

VARIABLE TIMED GAME: A timed game wherein each player has a specified period of time to complete a minimum of 20 moves. The specified period of time is selected at the beginning of the game. Failure to complete a mininum of 20 moves in the specified period of time entails loss of the game.

VARIABLE TIMED GAME PERIOD: A specified period of time wherein each player must make a minimum of 20 moves.

RATE (Rate of play): Refers to the rate each player is making moves, in a variable timed games, with respect to his clock wherein a zero indicates that the player is moving, on the average, fast enough to make exactly 20 moves in a specified period of time and a positive or negative number indicates the player is moving, on the average, faster or slower than required to make 20 moves in a specified period of time.

MOVES: For a non-timed game the capitalized word, MOVES, refers to the number of legal moves made since the beginning of the game. For a variable timed game MOVES refers to the difference between 20 and the minimum number of additional moves that must be completed before the end of a variable timed game period.

NEW: Term referring to one or more new chessmen on the playing field that had not been there previously.

MISSING: Term referring to one or more missing chessmen on the playing field that had been there previously.

ERROR: Refers to an error condition on the playing field wherein one of the following states exist in regard to the number of "NEW" and "MISSING" chessmen on the playing field: [Zero "NEW" & two or more "MISSING"] or [one "NEW" & zero "MISSING"] or [two "NEW" & one "MISSING"] or [two or more "NEW" & zero "MISSING"] or [one or more "NEW" & three or more "MISSING"] or [three or more "NEW" & one or more "MISSING"].

Referring now specially to FIG. 1, it may be seen that according to the present invention there may be readily constructed an apparatus 10 for playing the chess-like game of Kriegspiel that may be readily transported by a human with little effort. The invention comprises two adjacent chess-like boards 12 and 14 containing all controls and displays (a detailed representation of each board is shown in FIG. 2 and FIG. 3) wherein each board contains a playing field 25 and 27 consisting of 64 rectangles in an 8 by 8 matrix separated by a partition 16 of suitable size to conceal the moves made by each player, two sets of chessmen (indicated by reference numerals 13,15,17, and 19) positioned on each board 12 and 14, sensors imbedded in each rectangle to detect the position of each chessman (128 in number as will be more clear hereinafter with respect to FIG. 2 and FIG. 3), switches 23 to select various game options, a plurality of displays 21 to visually indicate the status of the game, speakers (contained beneath game boards 12 and 14) to audibly transmit information to the players, and a central processing unit (as shown in FIG. 4) that determines the status of the game and makes all required announcements to the players.

For a more complete understanding of the invention a brief description of the game of Kriegspiel is herein presented. The game originated in Switzerland in 1811 and was considered to be very instructive to military students because its play correlates favorably with military battlefield operations where moves must be made on the basis of limited intelligence with respect to the deployment of the opposing forces. The game is played using the rules of chess, but with the significant difference that the opponent's moves are hidden from view.

Each player uses his own board, which his opponent cannot see, and maintains with each move the position of his own forces and disposes a second set of men representing his opponent's forces, as he thinks them to be on his opponent's board. On each move the referee announces, "white to move" or "black to move". The player then moves in accordance with the limited inference which he may draw from the announcement of the referee, if any are given. The referee must announce all captures and the square on which it takes place, but not the type of chessman making the capture. If a pawn is captured, the announcement is "Pawn captured", and if a chessman other than a pawn is captured (queen, bishop, knight, or rook) the announcement is "Piece captured". A "check" places the king in danger of capture and an appropriate move must be made to remove the check. The referee announces all checks and the direction from which it is made, as, "Black is in check on the vertical" (or on the horizontal, on the diagonal, or by a knight). On each move the referee announces to the player to move next all possible captures that can be made by his pawns. (Herein referred to as "Pawn Tries"). Only the number of Pawn Tries are announced, but not the location or type of chessman that will be captured. If a Pawn Try is indicated and a consequent capture is made (put not necessarily by the pawn) the referee announces, as in any capture, "pawn captured" or "piece capture" and the location of the capture. Any attempted move, if legal, stands as played. If an illegal move has been made, the referee merely says "no" and the player must then seek a correct move. The object of the game is to place the opponent's king in "checkmate", that is, to have it in a position where it can be captured on the next move, no matter what the opponent's next move is. At the present time there are no offical rules for the game of Kriegspiel and all references to Kriegspiel herein pertains generally to any variations of the foregoing generally described game or to similar forms of blind chess.

Figure 2:
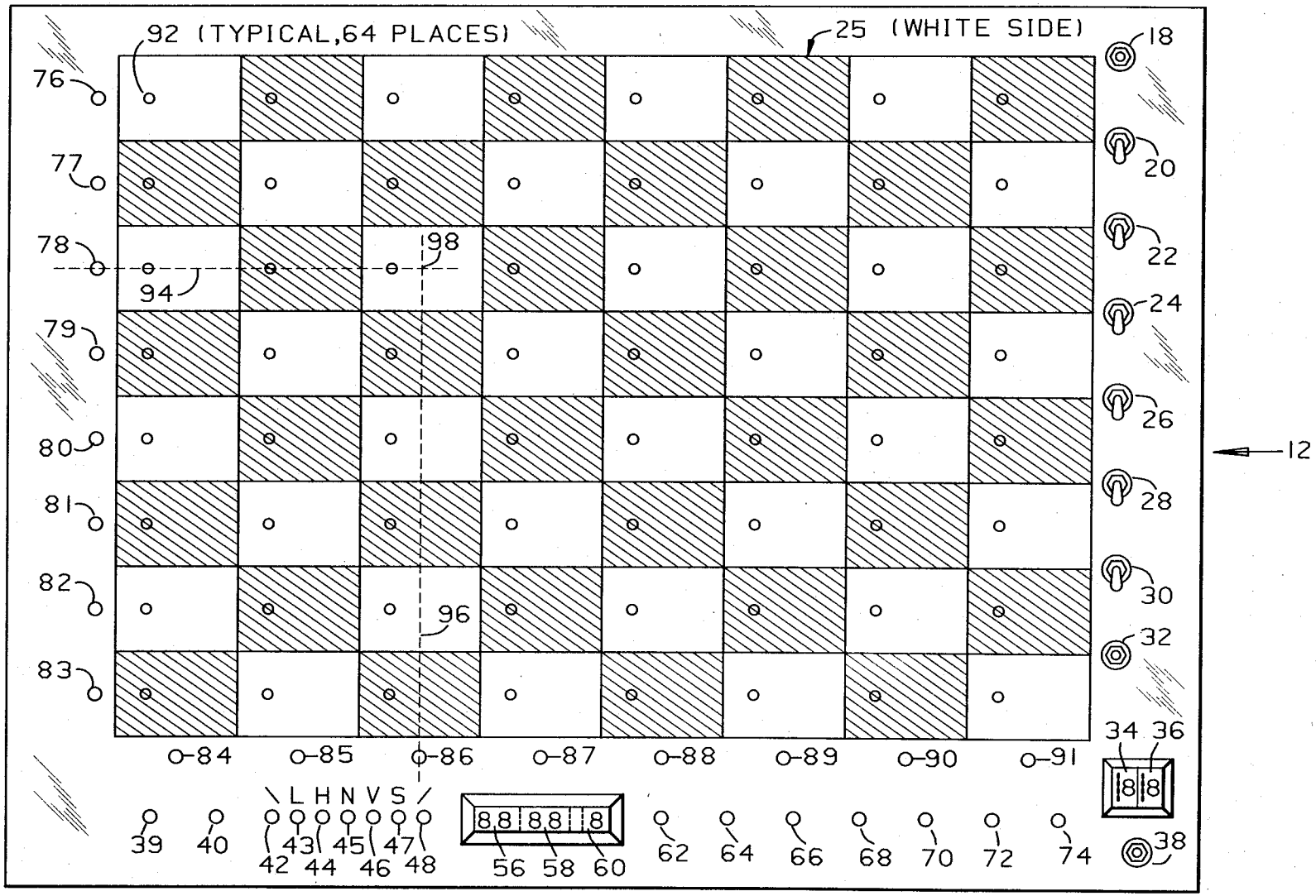
FIG. 2 shows a detailed representaion of the game board of the game of FIG. 1 as perceived by the player with the white game pieces.
Figure 3:
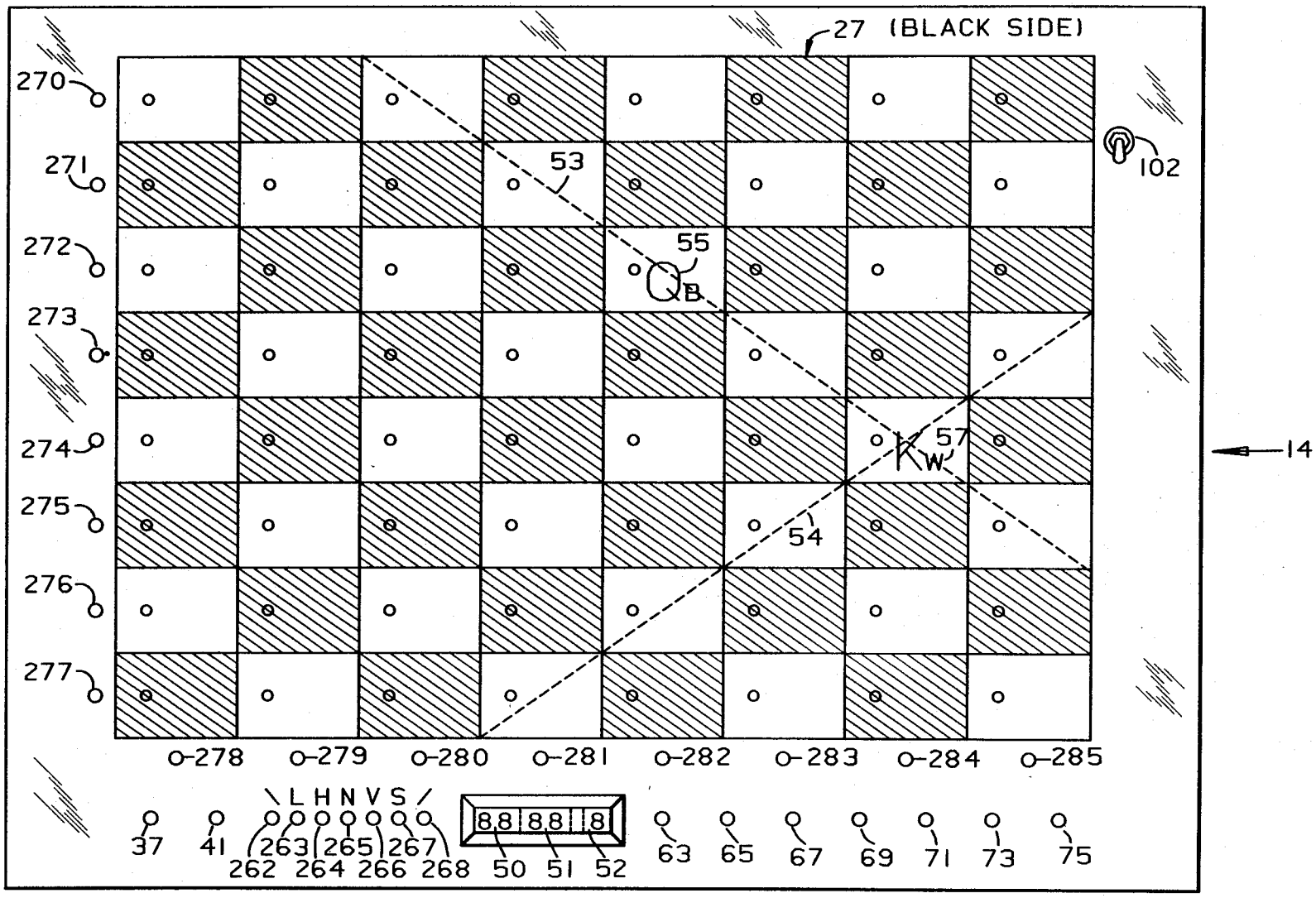
FIG. 3 shows a detailed representation of the game board of the game of FIG. 1 as perceived by the player with the black game pieces.
Figure 4:
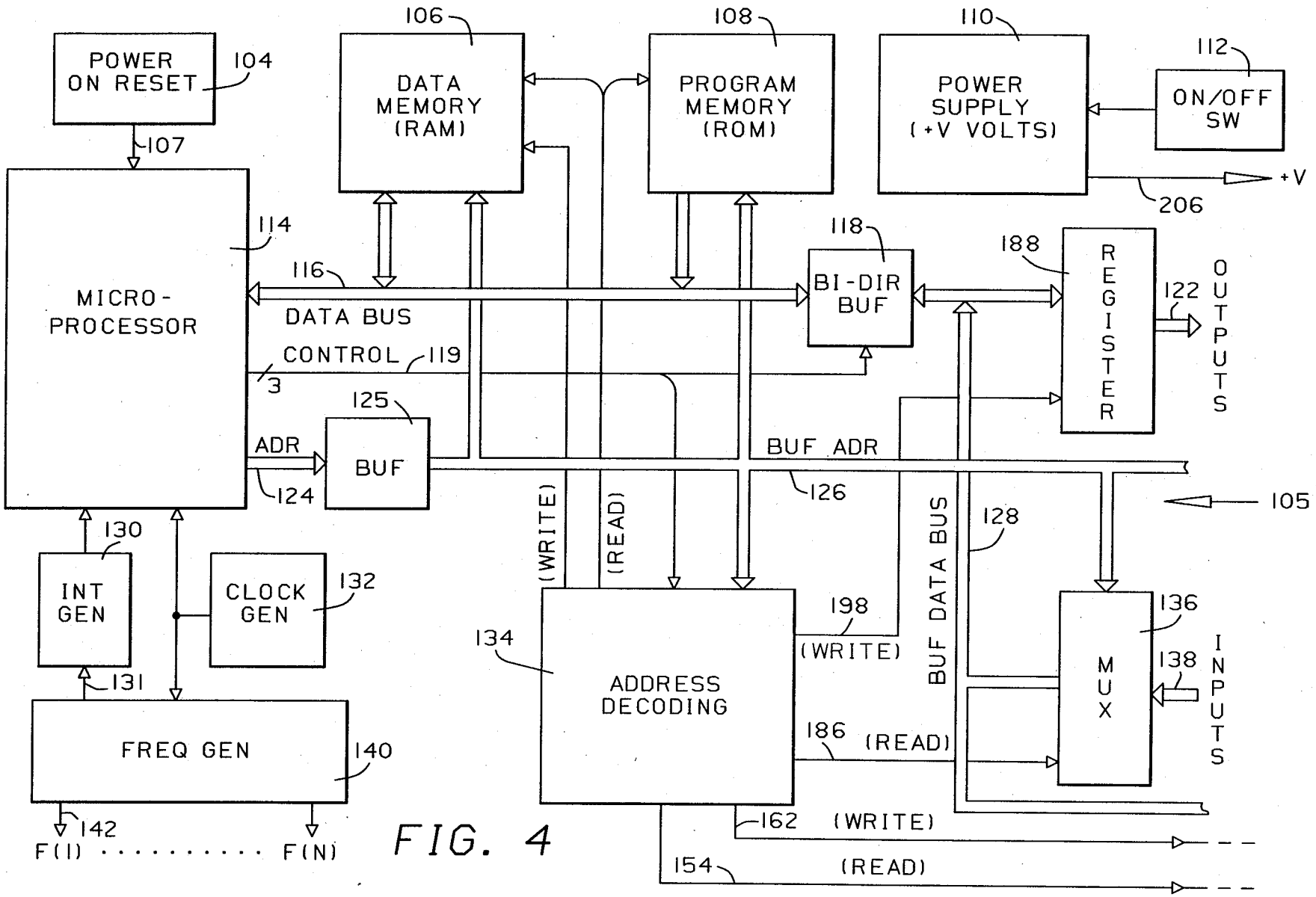
FIG. 4 is a block diagram schematic of the central processing unit contained within the game of FIG. 1.

Referring now specially to FIG. 2 and FIG. 3 it may be seen that the two adjacent chess-like boards 12 and 14 each consist of 64 rectangles in an 8 by 8 matrix with sensors imbedded in each rectangle to transmit to the electronic processing unit the position of each chessman on the playing fields 25 and 27. The sensors can be of various types including photocells, phototransistors, and Hall effect transistors. The term "rectangular" includes squares, as in a common chessboard or checkerboard arrangement. However, in a preferred embodiment of the invention, non-square areas are employed, as hereinafter described.

The control and display boards 12 and 14 of this game comprise a plurality of light emitting diodes to indicate the present status of the game. Leds 76 thru 91 in FIG. 2 and leds 270 thru 285 in FIG. 3 (herein referred to as MATRIX leds) are energized by the central processing unit (FIG. 4) to identify any one of the 64 rectangles on the playing fields 12 and 14 respectively. By turning on one of the row leds (76 thru 83) and one of the column leds (84 thru 91) any one of the 64 rectangles on the playing field 25 can be identified. An example of this technique is illustrated in FIG. 2 wherein one rectangle is identified by the intersection 98 between a horizontal line 94 and vertical line 96 drawn thru the two activated leds 78 and 86. A similar procedure is used to identify the location of any one of the 64 rectangles on the playing field 27 in FIG. 3. Leds 72 and 73 indicate checkmate; leds 74 and 75 indicate stalemate; leds 70 and 71 indicate a chessman is not covering a sensor (PLAYER OFF BOARD) as defined by the MATRIX leds; led 68 and 69 indicate an error exists on one of the playing fields 25 or 27 at the location defined by the MATRIX leds; leds 66 and 67 indicate an illegal move (herein referred to as a "NO" move) has been made by the chessman at the location on the playing field 25 or 27 as defined by the MATRIX leds; leds 64 and 65 (CONFIRM MOVE) indicate that a move made on one of the playing fields must be confirmed before it will be accepted as an attempted move as defined by the MATRIX leds; led 62 (WHITE) indicates "white to move next" while led 63 (BLACK) indicates "black to move next"; leds 42 through 48 and 262 through 268 indicate the player to move next is in check in the direction or directions indicated by one or more leds with the symbols \ (42 and 262) and / (48 and 268) indicating check in a diagonal direction; symbols V (46 and 266) and H (44 and 264) indicating check in the vertical and horizontal directions; symbol N (45 and 265) indicating check by a knight; and symbols L (43 and 263) and S (47 and 267) indicating check in the long or short diagonal directions as defined by the location of the king. Leds 40 and 41 (PIECE CAPTURE) and 39 and 37 (PAWN CAPTURE) indicate a piece or pawn has been captured as defined by the MATRIX leds.

Displays 60 and 52 indicate the number of pawn tries; displaying either a "P" to indicate one or more pawn tries or a specific number thereby indicating the exact number of pawn tries. This display format depends on the pawn try option selected at the beginning of the game with switch 26 (NUMBER OF PAWN TRIES ANNOUNCED). For a variable length timed game, a game wherein each player has a specific period of time to make a minimum of 20 moves, multiplexed displays 56 and 58 on the white side (FIG. 2) will display "minutes" and "seconds" respectively for a period of two seconds (minutes and seconds remaining for white) and concurrently multiplexed displays 50 and 51 on the black side (FIG. 3) will display "minutes" and "seconds" respectively for a period of two seconds (minutes and seconds remaining for black). Following this two second period display 56 will display white's "rate of play" and display 58 will display "the number of moves" made by white for a period of two seconds and concurrently display 50 will display black's "rate of play" and display 51 will display "the number of moves" made by black for a period of two seconds.

For a fixed length timed game, a game wherein each player has a fixed amount of time to compete against his opponent, displays 56 and 58 on the white side will display the time remaining for white and displays 50 and 51 on the black side will display the time remaining for black. For a non-timed game displays 56 and 58 on the white side will indicate the number of moves made by white since the beginning of the game and displays 50 and 51 on the black side will indicate the number of moves made by black since the beginning of the game.

The control and display boards 12 and 14 also comprise a plurality of switches to select various optional game rules and game procedures. Switches 102 (PROGRAM ENABLE) allows the player on the black side of the board 14 to enable the control switches located on the white side of the board 12. All references to the use of control switches on the white side of the board implys that switch 102 (PROGRAM ENABLE) on the black side is "on". Switch 26 (NUMBER OF PAWN TRIES ANNOUNCED) allows for the selection of two variations in announcing "Pawn Tries". In the "on" position the exact number of pawn tries are announced and in the "off" position a "P" is displayed to indicate one or more pawn tries but not the exact number. Switch 28 (PAWN PROMOTIONS ANNOUNCED) allows for the selection of two variations in Pawn Promotions. (Pawn promoted to a queen when it reaches the 8th rank). In the "on" position an audible and visual announcement is made to indicate a pawn has reached the 8th rank and is being promoted. In the "off" position no announcement is made when a pawn is promoted.

Switch 30 (DIAGONAL CHECK) allows for the selection of two variations in announcing diagonal checks. In the "on" position the diagonal direction of the check is announced as defined by a line connecting the king (the one in check) and the checking chessman. (Indicated by the symbol "\" and "/" above each led 42 and 48 in FIG. 2 and above each led 262 and 268 in FIG. 3). In the "off" position the diagonal direction of the check is announced as LONG or SHORT as indicated by the symbols "L" and "S" above each led 43 and 47 in FIG. 2 and above eack led 263 and 267 in FIG. 3 and as herein defined. The total number of rectangles are counted along the diagonal passing through the king (the one in check) and the checking chessman and extending in both directions to the edge of the playing field. This total number of rectangles is compared to the number of rectangles on the diagonal passing through the checked king and at right angles to the first diagonal and extending in both directions to the edge of the playing field. If the number is greater the announcement is long ("L") diagonal check and if the number is smaller the announcement is short ("S") diagonal check. An example to illustrate this definition is shown in FIG. 3. The total number of rectangles along the diagonal line 53 connecting the white king 57 and the black queen 55 and extending in both directions to the edge of the playing field is 6. The total number of rectangles on the diagonal line 54 passing through the white king 57 and at an approximate right angle to the first diagonal line 53 and extending in both directions to the edge of the playing field is 5. Therefore, since 6 is greater than 5 the king is in check on the long diagonal. (Diagonal line 53 is longer than diagonal line 54).

Push button switch 38 (ENTER) and thumbwheel switche 36 (PROG) allow for the programming of chessman onto the playing fields 25 and 27 and the selection of fixed or variable length timed games. As mentioned earlier, switch 102 (PROGRAM ENABLE) must be "on" to enable control functions on the white side (FIG. 2), such as programming. If "C" (CLEAR) is selected with thumbwheel switch 36 and switch 38 (ENTER) is pressed, the memory contents associated with the position of all chessman on the playing fields 25 and 27 are cleared. This clearing procedure is necessary if individual chessmen are to be programmed at arbitrary locations on the playing fields. If one or more chessmen, of the same type, are placed on vacant sensors on the playing fields and the "K" (KING), "Q" (QUEEN), "B" (BISHOP), "N" (KNIGHT), "R" (ROOK), or "P" (PAWN) is selected with thumbwheel switch 36 and switch 38 (ENTER) is pressed, the corresponding type of chessman will be programmed onto the playing fields at all specified locations. This procedure is continued until all desired chessmen have been programmed onto the playing fields.

If "F" (FIXED) is selected with thumbwheel switch 36 and switch 38 (ENTER) is pressed both playing fields 25 and 27 are programmed for a normal Kriegspiel game with a total of 32 chessmen (16 on each side of the board) programmed onto the playing fields in the normal starting positions and a non-timed or fixed length time game will be played depending upon the number selected on thumbwheel switch 34 (TIME). If zero is selected on thumbwheel switch 34 (TIME) a non-timed game will be played with no time limit imposed on the players. If 1 through 9 is selected on thumbwheel switch 34 (TIME) a fixed length timed game will be played with each player having between 5 and 30 minutes of total playing time. Any player who runs out of time automatically loses the game. If "V" (VARIABLE) is selected on thumbwheel switch 36 and switch 38 (ENTER) is pressed both playing fields are programmed for a normal Kriegspiel game with a total of 32 chessmen programmed onto the playing fields and a non-timed or variable length timed game will be played depending upon the number selected on thumbwheel switch 34 (TIME). If zero is selected on thumbwheel switch 34 (TIME) a non-timed game will be played and if 1 through 9 is selected a variable length timed game will be played with each player having between 1 minute and 40 seconds (average of 5 seconds per move) and 30 minutes (average of 90 seconds per move) to make a minimum of 20 moves. Failure to complete the required minimum number of moves within the time period entails loss of the game. During variable length times games multiplexed displays 56 and 50 (RATE) indicate the rate each player is moving by displaying zero if the player is moving, on the average, fast enough to make exactly 20 moves in the allotted period of time; a positive number between 1 and 9 if the player is moving, on the average, faster than is required to make 20 moves in the allotted period of time, with plus 1 indicating one move ahead, plus 2 indicating 2 moves ahead, etc; and a negative number between −1 and −9 if the player is moving, on the average, slower than is required to make 20 moves in the required period of time, with −1 indicating one move behind, −2 indicating 2 moves behind, etc. This "rate" feature allows the players to determine at a glance if they are risking loss of the game by moving too slow and may run out of time or if they are risking loss of the game by moving too fast which may result in hasty decisions without proper analysis. Also, during variable length timed games the minimum number of moves that must be made by each player before their multiplexed time displays 56 and 58 (white side) or 50 and 51 (black side) count down to zero is equal to the difference between 20 and the number shown in multiplexed displays 58 (white side) or 51 (black side). This number is referred to as "MOVES". This means loss of the game will occur to any player who fails to move fast enough to maintain a number equal to or greater than 20 in his MOVES display 58 (white side) or 51 (black side) at the exact instant his allotted time period expires. When the time displays count down to zero a check is performed of the count in the MOVES display. If the count is less than 20 the game is terminated since one player has failed to make a minimum of 20 moves in the allotted period of time. This type of loss is announced by simultaneously flashing both the CHECKMATE 72 and 73 and STALEMATE 74 and 75 leds on both sides of the board. (Out of time). If the count is equal to or greater than 20, then 20 is subtracted from the count and the time displays 56 and 58 on the whie side or 50 and 51 on the black side are reset to their prescribed initial period. The following example illustrates the above procedure. When the time displays 56 and 58, on the white side, counted down to zero, the MOVES display 58, on the white side, indicated 22 moves. Therefore, 20 is subtracted from 22 resulting in 2. This number is displayed in the MOVES display 58. Since the player made 2 additional moves over and above the required 20 moves, he will be required to make only 18 moves during the next time period. This procedure allows players during non-critical periods of the game to accumulate moves by making more than 20 moves in the specified period of time (moving fast than the average rate). The accumulated moves can then be used during critical periods of the game by making fewer than 20 moves in the specified period of time (moving slower than the average rate).

Switch 32 (START) allows the player on the white side to start the game by pressing said switch after switch 102 (PROGRAM ENABLE) is turned "off".

Switch 18 (DELETE) allows for the deletion of chessmen from the playing fields by removing one or more chessmen from their sensors and pressing the switch. All chessmen missing from their sensors (at the time DELETE switch 18 is pressed) will be deleted from the data memory.

Switch 20 (RELAY) allows the replaying of the last game by turning the switch "on" and pressing switch 38 (ENTER). During the replay procedure both the white and black chessmen 13 and 17 are positioned on sensors on the white playing field 25 to help aid in the visualization of the opposing forces, with the black playing field 27 not in use. The white MATRIX leds instruct the players to move the chessmen, one at a time, in accordance with the actual moves made in the last game.

Switch 22 (REVERSE) allows the last and previous moves to be taken back by turning the switch "on". Following this procedure the MATRIX leds, on the appropriate side, instruct the players to move the chessmen, one at a time, back to their previous positions until the reverse switch 22 is turned "off".

Switch 24 (BRANCH) allows players to analyze a previously played game. During the replaying of a game it is often desirable to analyze a different set of moves to determine if the outcome would have been favorable. If a player wishes to try a different set of moves he can activate the branch switch 24 and all subsequent moves will be stored in data memory. When he has completed his analysis of the new sequence of moves he turns the branch switch 24 "off" and the white MATRIX leds will instruct him to move the chessmen, one at a time, back to the locations where they were before the branch option was initiated. Following this procedure the normal replay operation continues as before.

In operation the players at the beginning of the game select optical game rules with programming switches 26 (NUMBER OF PAWN TRIES ANNOUNCED), 28 (PAWN PROMOTIONS ANNOUNCED), and 30 (DIAGONAL CHECK). Chessmen are programmed onto the playing fields as described earlier with switches 36 (PROGRAM) and 38 (ENTER). If one or more chessmen are programmed onto the wrong locations on either the white or black playing fields they can be deleted from data memory by lifting them off their sensors and pressing switch 18 (DELETE). This will simultaneously delete from the data memory all chessmen that have been lifted from either the white or black playing fields. Following the programming procedure the players select either a fixed length timed game, a variable length timed game, or a non-timed game with switches 34, 36, and 38. Switch 102 (PROGRAM ENABLE) on the black side must be activated during the above programming operations. On the white 25 and black 27 playing fields chessmen 13 and 17 are placed on their appropriate sensors and a second set of chessmen 15 and 19 (preferably of translucent or transparent material to allow the passage of light in the event the chessmen accidently cover the sensors) are placed on their appropriate rectagular elements to represent the opposing forces. The chessmen 15 and 19 are placed on the rectangular elements to the right of the sensors. This eliminates any interference with the placement of chessmen 13 and 17 on the sensors of the same rectangles during the course of the game, such as, during the capturing of opposing chessmen. Square elements of suitable size can be used to allow sufficient space for two chessmen to be placed concurrently on the same element. However, a rectangular shape is preferred, because the rectangles can be made narrower in the vertical section for a given size of game pieces. The partition 16 is positioned between the white and black playing fields 25 and 27 to conceal the moves made by each player. The game is started by turning switch 102 (PROGRAM ENABLE) "off" and pressing switch 32 (START).

The WHITE led 62 will continuously flash to indicate white is to move next. The BLACK led 63 will be "off". If a white chessman 13 is lifted from its sensor on the playing field 25 the white PLAYER OFF BOARD led 70 will flash to indicate a chessman is not covering its sensor. The white MATRIX leds will flash to indicate the location of the lifted chessman.

For a non-timed game displays 56 and 58 on the white side 12 and displays 50 and 51 on the black side 14 will display "0" indicating zero moves have been made since the beginning of the game. Upon completion of white's first move displays 56 and 58 on the white side will be incremented and will display 1. Displays 50 and 51 on the black side will still display "0" until black completes his first move. On each subsequent move the displays on both sides will be alternately incremented by one to indicate the number of moves each player has made since the beginning of the game. For a fixed length timed game displays 56 and 58 on the white side will display the time remaining for white and displays 50 and 51 on the black side will display the time remaining for black. For a variable length timed game multiplexed displays 56 and 58 on the white side will display "minutes" and "seconds" respectively for a period of two seconds (minutes and seconds remaining for white) and concurrently multiplexed displays 50 and 51 on the black side will display "minutes" and "seconds" respectively for a period of two seconds (minutes and seconds remaining for black). Following this two second period, and lasting for an additional 2 seconds, display 56 will display white's "rate of play" and display 58 will display "the number of moves" made by white while display 50 will display black's "rate of play" and display 52 will display "the number of moves" made by black.

Following white's first move an audible beep ("transfer" beep) will occur for approximately one second to indicate white has completed a legal move and its black's turn to move next. Led 62 indicating its white's turn to move next will turn "off" and led 63 indicating its black's turn to move next will turn "on". The "transfer" beep will occur each time a player completes a legal move to alert his opponent that its his turn to move next. It should be noted, that a speech synthesizer chip could be used as an alternate method for making aural announcements.

If an illegal chess move is made that results in the player to move next attempting to jump over an opposing chessman or results in that player attempting to place his king in jeopardy of being captured on the next move then the NO leds 66 and 67 on both sides of the board will flash for the duration of the illegal condition and an audible tone will be emitted for approximately one second to indicate the attempted move is illegal. The MATRIX leds on the side to move next will flash to indicate the location of the illegal move.

If a move is attempted with one or more chessmen that will always be defined as an illegal move under any and all circumstances then a special announcement is made consisting of a single double frequency beep tone and flashing leds. The ERROR leds 68 and 69 on both sides of the board will flash for the duration of the erroneous move. Also, if any other type of error condition, as defined earlier in the definition of terms, accidently occurs on the playing field of the side to move next, the error leds 68 and 69 will flash to indicate the error condition. In all cases the MATRIX leds, on the side to move next, will flash to indicate the location of the error. If multiple error conditions are present the MATRIX leds will indicate the location of one error at a time. When that error condition is eliminated the MATRIX leds will indicate the location of the next error. This procedure will continue until all error conditions have been eliminated.

If a move results in one of the kings being placed in check (in one or possibly two directions) then a double beep tone will be repeated twice and one (or possibly two leds if the king is in check in two directions) will flash on both sides of the board for the duration of the check condition. This will announce the direction of the check or checks as indicated by the symbols ,L,H,N,V,S,/ above each led 42 thru 48 on the white side and each led 262 thru 268 on the black side.

On each move the central processing unit (FIG. 4) will announce to the player to move next all possible captures that can be made with his pawns. The pawn try announcement will consist of a single triple beep tone and flashing displays (52 and 60) on both sides of the board to indicate either the exact number of pawn tries (a number is displayed in 52 and 60) or that one or more pawn tries exit. (A "P" is displayed in 52 and 60). The displays 52 and 60 will continue to flash until the player with the pawn tries has made 3 or more unsuccessful attempts to cature an opponent's chessman with one or more of his pawns. The displays will then stop flashing and will remain on continuously to indicate 3 or more pawn tries have been unsuccessfully attempted. If this condition ocurrs the player with the pawn try is not permitted on that move to capture with any of his pawns and he must select an alternate move. If the pawn try still exists on his next move he will again be given three attempts to capture.

If a capture is made, by the player to move next, an audible and visual announcement is made consisting of a repeated double beep tone and flashing leds on both sides of the board. If a pawn was captured the PAWN CAPTURED leds 37 and 39 will flash and if a piece was captured the PIECE CAPTURED leds 40 and 41 will flash. The MATRIX leds on the side that lost the chessman will flash to indicate the location of the captured chessman. The audible and visual announcement will continue until the captured chessman is removed from the playing field.

If a player makes his next move while it is still his opponent's turn to move (advance move) and his opponent's next move results in placing him in check, results in capturing one of his chessmen, or results in giving him a pawn try then the appropriate CONFIRM MOVE led 64 or 65 and MATRIX leds on his side of the board will be activated to indicate he is to confirm his advance move. This confirmation is necessary since new information is now available that was not present when the advance move was first initiated. Confirmation of the advance move is performed by replacing all moved chessmen back to their original locations. The move, that had been initiated in "advance", can then be made or the player can select an alternate move if he so desires.

Players, upon agreement with their opponent, can take back their previous moves by turning switch 102 (PROGRAM ENABLE) "on" (black side of board) and turning switch 22 (REVERSE) "on" (white side of board). The MATRIX leds will instruct the players to move the chessmen, one at a time, back to their previous positions until switch 22 (REVERSE) is turned "off".

If a player is checkmated or stalemated the corresponding leds 72 and 73 or 74 and 75 respectively will flash on both sides of the board to indicate the final condition of the game.

The previous game can be automatically replayed by turning switch 102 (PROGRAM ENABLE) "on", turning switch 20 (REPLAY) "on" and pressing switch 38 (ENTER). To aid the players in visualizing the location of the two opposing forces the white 13 and black 17 chessmen are both placed on the white playing field 25, with the black playing field 27 not in use. The set of chessmen 15 and 19 representing opposing chessmen in a normal Kriegspiel game are not used during the replay procedure since they serve no useful purpose. The white MATRIX leds instruct the players to move the chessmen in accordance with the actual moves made in the last game. During the replaying of a game the branch switch 24 can be activated to help the players analyze a different set of moves than were previously made to determine if the outcome would have been favorable, as described earlier.

Referring now to FIG. 4 representing a block diagram of a preferred embodiment of the central processing unit 105 it can be seen that the system consits of microprocessor 114 connected to various support and peripheral elements. The microprocessor outputs addresses to the program memory 108, and executes the instructions which it receives from the program memory, thereby controlling the actual operation carried out by the system. The "sequence" is controlled by the order of the instructions in program memory, except for jumps, etc. The clock generator 132 produces a system clock signal consisting of a continuous waveform which is used to control all signal transitions within the system. The microprocessor 114 and support elements examine the system clock to determine when to output data or when to latch in data generated by other devices within the system. When the on/off switch 112 (which may have any convenient location and is not physically shown in the other drawings) is turned "on" the power supply 110 provides +V volts on line 206 to the electrical circuitry of the system. The power supply may be any conventional supply, either battery or externally powered, for providing the voltage with sufficient regulation to permit reliable operation of the system, typically +5 +/−0.5 volts. This activates the power-on reset element 104 to provide a reset signal 107 to the central processing unit 105 to initialize the various internal components and to force the microprocessor 114, such as device MPS 6502, to start execution of the program stored in the program memory device 108. The program memory stores the sequence of instructions which comprise the system program. This element puts a pattern of 1's and 0's on the data bus 116 in response to the address on the buffered address bus input 126. The program memory element 108, such as device MM2716Q, is constructed with "Read-only" memory so that the program data will not be lost when power is disconnected from the system. The data memory element 106, such as device MM2114N, is for the temporary storage of input data, the results of arithmetic operations, etc., and is constructed with read/write memory. (Random access memory). The microprocessor can store data in the data memory or it can read back data it has previously stored.

The address bus 124, the bi-directional data bus 116 and the control lines 119 allow the microprocessor to exercise direct control over the rest of the system. The address bus 124 outputs addresses to control the source or destination of data transfers. The bi-directional data bus 116 serves as a path for transferring data into and out of the microprocessor. The direction of the data transfer is determined by the control signals on lines 119. The address and bi-directional data bus buffers, such as devices SN74LS367N, (125 and 118 respectively) provide additional signal drive capability needed by the microprocessor in order to drive the various support elements connected to the buffered data 128 and buffered address bus 126.

The address decoding circuitry 134, comprising such devices as SN74LS138N, processes the buffered address bus 126 and control signals to provide read/write signals (such as on signal lines 198 and 186) to the various memory and input/output devices. The frequency generator circuit 140, comprising such devices as MC14040B, counts down the system clock signal to produce numerous frequencies needed to control the flashing of led displays and the audible tones emitted from the speakers. (Reference numeral 142 indicates one such signal line).

The interrupt generator circuit 130 produces a periodic timing signal that interrupts the microprocessor 114 at equally spaced time intervals to facilitate the maintainence of an accurate time record needed by the microprocessor to determine when time dependent operations must be performed.

The input device 136 (MUX), such as device SN74LS251N, allows the microprocessor to read the state of the input switches 23 (shown in FIG. 1) while the output device 188 (REGISTER), such as device SN74LS374N, permits the microprocessor to output data to the leds (such as devices HP5082-4650), displays, (such as devices MAN 72) and speaker circuitry. Other input devices are also connected to buffered data bus 128, as described hereinafter.

Figure 5:
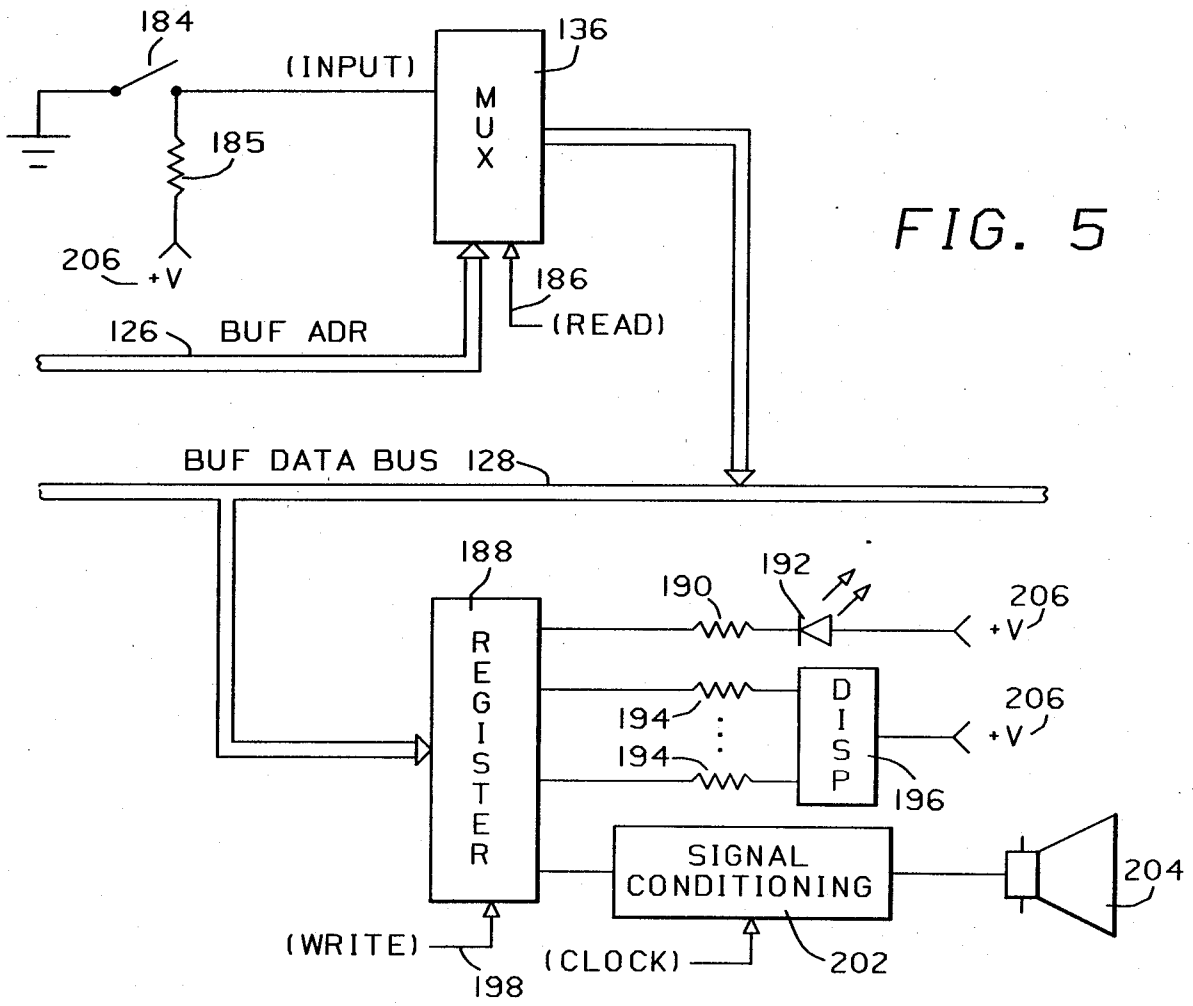
FIG. 5 is a block diagram schematic of a typical input and output circuit contained within the game of FIG. 1.

FIG. 5 illustrates a typical input configuation with a switch 184 and resistor 185 connected to one port of the input multiplexer 136 and a typical output configuation with register 188 driving led 192 through resistor 190, driving display 196 through resistors 194, and controlling signal conditioning circuit 202 which in turns drives speaker 204.

Figure 6:
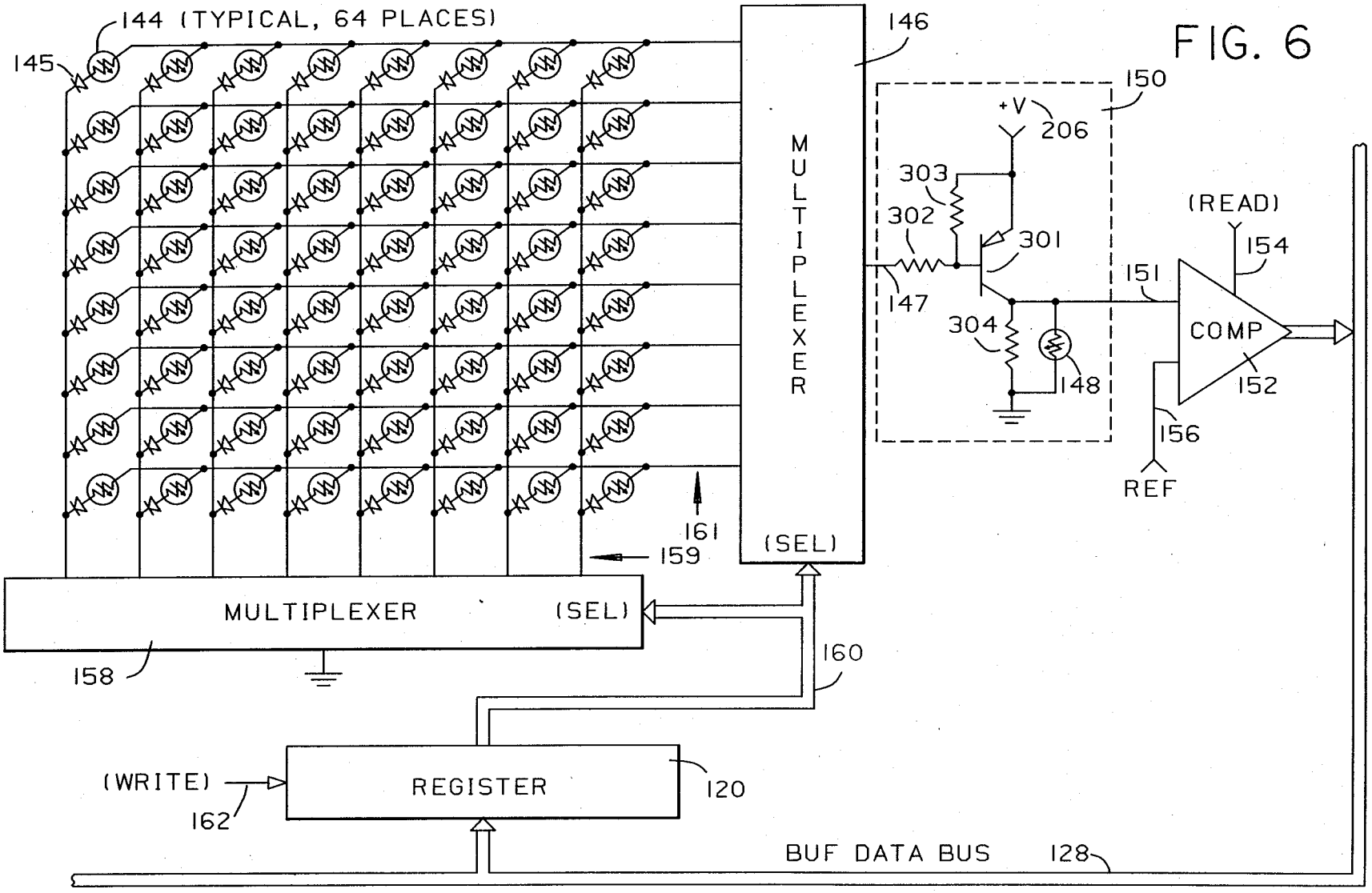
FIG. 6 is a block diagram schematic of the first embodiment of the board sensing circuit utilizing photocells as the sensing element contained within the game of FIG. 1.

An implementation of the board sensing circuitry, on the white side of the board 12, utilizing photocells, is shown in FIG. 6. A similar circuit (not shown) exits on the black side 14 for sensing chessmen. In an 8 row by 8 column matrix (indicated by reference numerals 161 and 159 respectively) 64 photocells and 64 diodes (one typical photocell, such as device Clairex CL9P9L, and diode pair is indicated by reference numerals 144 and 145 respectively) are connected in series as shown in FIG. 6. The 8 rows and 8 columns are further connected to two multiplexers 146, such as device CD4051B, and 158, such as device SN7442. By loading the appropriate number into register 120 the central processing unit 105 selects one of 64 photocells (144) to be electrically connected to the ambient light gain control circuitry 150. This is accomplished by multiplexer 158 grounding one of the 8 column lines 159 and multiplexer 146 selecting one of the 8 row lines 161 to be electrically connected to the input 147 of the ambient light gain control circuitry 150. The ambient light gain control circuitry provides amplification to the output 147 of multiplexer 146 as a function of the of the ambient light intensity falling on the playing field. Under different operating environments the ambient light intensity falling on the playing fields will vary and a cooresponding resistance variation will occur to the uncovered photocells 144. This will result in a variation of the current into the ambient light gain control circuitry 150. This current variation would normally result in a corresponding voltage variation at the input 151 of comparator 152. To offset this voltage variation a special photocell 148 (not physically shown in the other drawings) is installed in the outside perimeter of each board 12 and 14 to detect the ambient light condition and to control the amplification of the voltage signal 151 at the input of comparator 152. As the ambient light intensity varies the resistance of the ambient light sensor 148 also varies. This results in a compensating gain variation of the transistor circuit within the ambient light gain circuit 150. Resistor 302 determines the relative base drive of transistor 301, while resistor 303 increases the transistor response time by bleeding off excess base current during on/off transitions. The ratio of resistor 302 and 304, along with photocell 148, determines the voltage gain of circuit 150. If a chessman is covering a photocell 144, that has been selected by the central processing unit 105, the current passing through the photocell will be relatively small (photocell resistance is high) and the voltage at the input 151 of comparator 152 will be lower than the reference voltage 156 (REF) of comparator 152. This will result in the comparator outputting a low voltage. On the otherhand, if no chessman is covering the selected photocell 144 a relatively large current will pass through the photocell (photocell resistance is low) resulting in comparator 152 outputting a high voltage. The central processing unit then determines the presence or absence of a chessman by reading the high or low output 128 of comparator 152.

Figure 7:
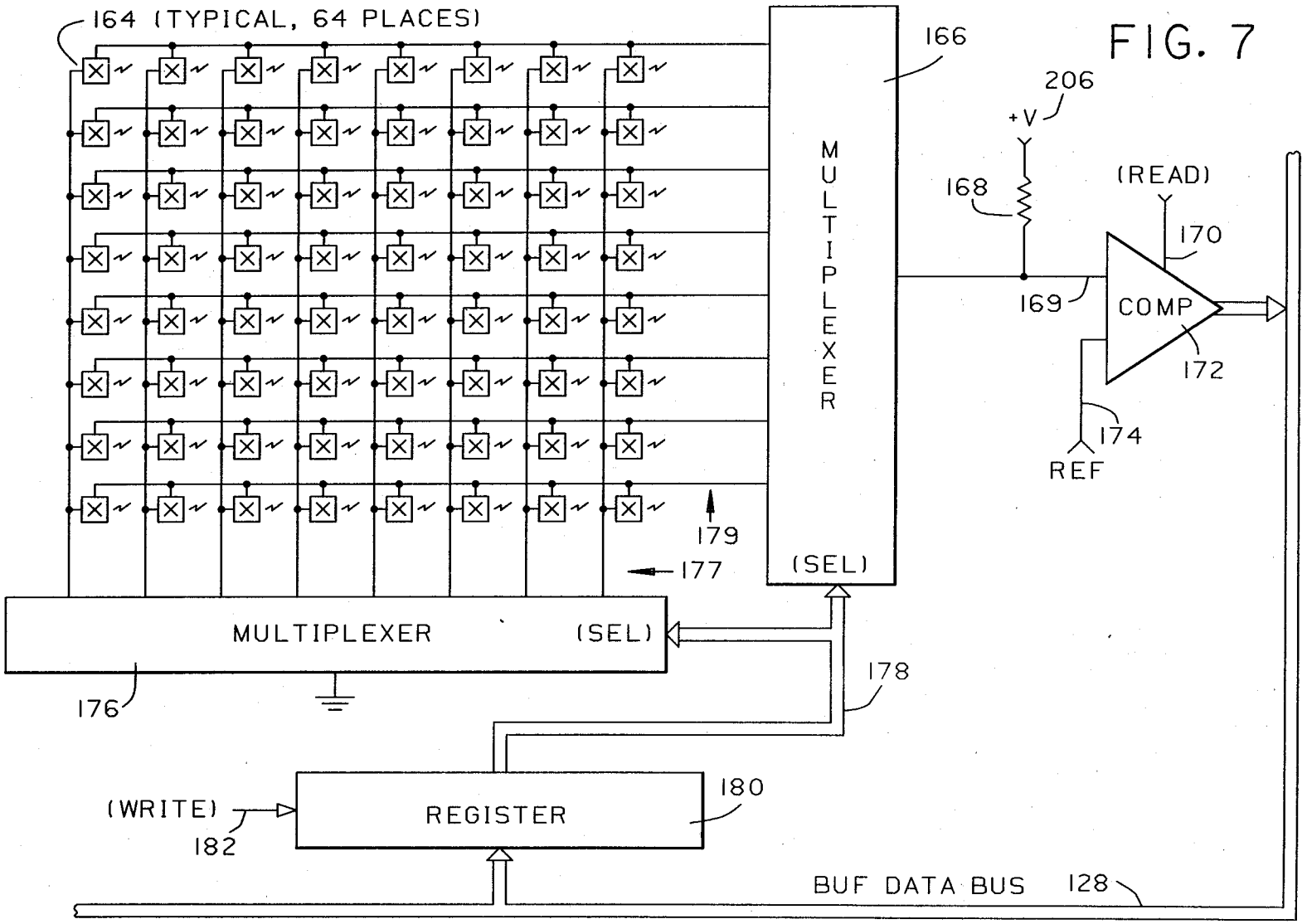
FIG. 7 is a block diagram schematic of the second embodiment of the board sensing circuit utilizing Hall effect transistors as the sensing element contained within the game of FIG. 1.

A second implementation utilizing Hall effect transistors is shown in FIG. 7. In an 8 row by 8 column matrix (indicated by reference numerals 179 and 177 respectively) 64 Hall effect transistors (one typical Hall effect transistor, such as device ULS 3006T (Sprague), is indicated by reference numeral 164) are connected as shown in FIG. 7. The 8 rows and 8 columns are further connected to two multiplexers 166 and 176. By loading the appropriate number into register 180 the central processing unit selects one of 64 hall effect transistors (164) to be electrically connected to comparator 172. This is accomplished by multiplexer 176 grounding one of the 8 column lines 177 and multiplexer 166 selecting one of 8 row lines 179 to be electrically connected to the input 169 of comparator 172. In this implementation each chessman in play has imbedded in its base a permanent magnet. (Not shown). As the magnet comes in close proximity of the hall effect transistor 164, the transistor is activated and sinks current from resistor 168. This lowers the voltage at the plus input 169 of comparator 172 below the negative input 174 of the comparator. This results in a high output voltage at the output 128 of comparator 172. When the magnet is not in close proximity of the hall effect transistor 164, the transistor de-activates and the voltage at the plus input 169 of comparator 172 rises above the negative input 174 of the comparator. This results in low output voltage at the output 128 of the comparator. The central processing unit then detects the presence or absence of a chessman by reading the high or low output of comparator 172.

Figure 8:
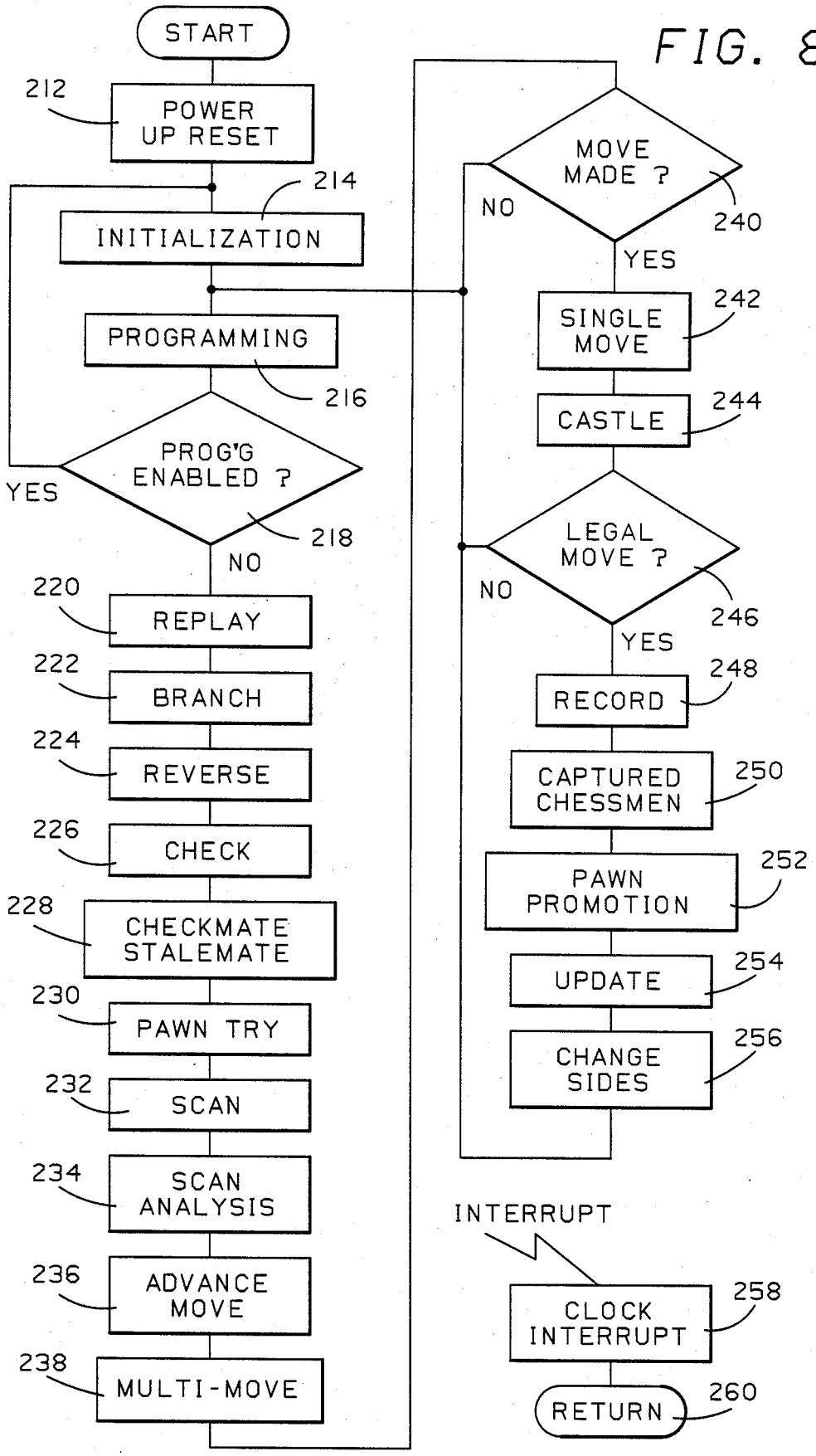
FIG. 8 is a software block diagram flow chart of the computer program contained within the game of FIG. 1.

Referring to FIG. 8 representing a block diagram flowchart of the system program it can be seen that the program consists of numerous subroutine elements and an interrupt routine 258 connected together to form a processing system that determines the status of the game and makes all required announcements to the players.

The Power-On Reset circuit 104 shown in FIG. 4 generates a reset/start signal 107 to reset the central processing unit 105 and force the mircoprocessor 114 to start execution of the Power-Up Reset routine 212. This routine clears all data memory locations that are allocated for the storage of positional information of chessmen on the playing fields and then branches to the Initialization routine 214. The Initialization subroutine initializes all memory variables, internal processor flags, and hardware circuitry at the beginning of the game. The Programming subroutine 216 defines the location of all chessmen on the playing fields, and defines optional game rules, such as, timed or non-timed games, fixed or variable length games, pawn promotions, and diagonal checks by scanning the input switches 23 that control programming and optional game rules. If programming has been enabled the system program will branch back to the Intialization subroutine 214 upon exiting the Programming subroutine 216, otherwise the system program will fall through and execute the Replay subroutine 220. The Replay subroutine 220 allows the previous game to be automatically replayed and is activated by turning switch 102 (PROGRAM ENABLE) "on", turning switch 20 (REPLAY) "on", and pressing switch 38 (ENTER), as described earlier. The location of all moves made in the previous game are contained in the data memory 106 and are accessed by the Replay subroutine 220 to determine which white MATRIX leds should be activated to instruct the players to move the chessmen in accordance with the actual moves made in the last game. The following 9 announcements will be repeated during the replay operation to aid the players in a better understanding of the previous game: player to move next (white or black), check direction, pawn capture, piece capture, pawn try, number of moves made (since the beginning of the game), checkmate, stalemate, and beep tone to indicate a new player to move next. The following 5 announcements will not be made during the replay operation since they require extra memory to store the event and are not considered to be of great value: no, player off board, time, confirm move, and errors made during the previous game. The Branch subroutine 222 allows players to analyze previously played games. During a replay operation, a player can try a different set of moves than were originally played by turning "on" switch 24 (BRANCH). All subsequent moves will be stored in the data memory 106. When he has completed his analysis of the new sequence of moves he turns the BRANCH switch 24 "off" and the white MATRIX leds will instruct him to move the chessman, one at a time, back to the locations where they were before the branch option was initiated. Following this procedure the normal replay operation continues as before. The Reverse subroutine 224 allows the players to take back their previous moves and is activated by turning switch 106 (PROGRAM ENABLE) and switch 22 (REVERSE) "on". The subroutine instructs the players, with the aid of the appropriate white or black MATRIX leds, to move the chessmen, one at a time, back to their previous positions by accessing the data memory 106 that contains the locations of all completed moves. If during the Replay, Branch, or Reverse operations the players fail to move the chessmen in accordance with the instructions given by the appropriate MATRIX leds, an error condition will be initiated by turning "on" the ERROR leds 68 and 69, emitting a single double frequency tone, and by turning "on" the apropriate MATRIX leds to indicate the location of the error condition.

The Check subroutine 226 analyzes the position of all chessmen as defined by the data memory 106 and determines if the the player to move next was placed in check by his opponent's last move. If so, the subroutine flashes the appropriate CHECK leds 42 thru 48 and 262 thru 268 on both sides of the board and emits a single double beep tone to alert the players to the check condition. The Checkmate/Stalemate subroutine 228 also analyzes the position of all chessmen as defined by the data memory and determines if the player to move next is checkmated or stalemated as defined by the rules of chess. The player is checkmated if his king is in a position wherein it can be captured on the next move, no matter what his next move is. The player is stalemated if one or more of the following three conditions occur: he is in a position wherein the only possible move he can make would place his king, which is not presently in check, in a position wherein it could be captured on the next move, neither player has sufficient force to checkmate his opponent, or 50 moves have been completed by each player without a pawn advancement or capture taking place. If the player is determined to be checkmated or stalemated the subroutine will flash the appropriate leds 72 and 73 or 74 and 75 respectively on both sides of the board to announce the condition.

The Pawn Try subroutine 230 analyzes the position of all chessmen as defined by the data memory and determines if the player to move next has any pawns in position that can capture one or more of his opponent's chessmen. A pawn try is only defined as a potential capture made by a pawn if the resulting move does not place the player's king in check. In other words, if in the attempt to capture an opponent's chessman with a pawn, the player places his king in check, then the Pawn Try subroutine will not define that move as a pawn try. In one pawn try option the exact number of unique ways that captures can be made with pawns is announced (the number is displayed in the white and black pawn try displays 52 and 60), while in the other option only the fact that one or more pawn tries exist is announced (a "P" is displayed in the white and black pawn try displays 52 and 60). In both cases a single triple beep tone is emitted one time to alert the players to the pawn try condition. The Pawn Try subroutine will continuously flash the pawn try announcement until 3 or more unsuccessful attempts to capture a chessman with one or more pawns has occured. Following this condition the pawn try displays 52 and 60 will stop flashing and will remain on continuously to indicate 3 or more pawn tries have been unsuccessfully attempted. Also, if this condition occurs the player with the pawn try will not be permitted, on that move, to capture with any of his pawns. He must select an alternate move.

The Scan subroutine 232 determines the location of all chessmen on the white playing field 25 by loading the appropriate number into register 120 (FIG. 6) to control the multiplexers 158 and 146 connected to the sensors 144 and by reading the resultant output from comparator 152. The subroutine determines the number and location of all chessmen that are missing from the playing field by comparing the present location of all chessmen with the last known location of all chessmen as determined by the data memory 106. The number and location of all new chessmen on the playing field is determined in a similiar manner. The Scan subroutine 232 processes data from the black playing field 27 by controlling a similar sensing circuit (not shown) located on the black side of the board.

Referring back to FIG. 8 the Scan Analysis subroutine 234 determines the status of the playing fields by processing the results of the scan subroutine 232. If the subroutine determines that chessmen have not been removed from or added to the playing field it will return a value of 2. If a chessman has been lifted off the playing field (on the side to move next) the subroutine will announce this condition by activating the PLAYER OFF BOARD leds 70 or 71 and the MATRIX leds on the appropriate side of the board. Also, the subroutine will turn "off" the ERROR leds 68 and 69 and NO leds 66 and 67 and will return a value of 2. If a chessman has been lifted and moved to a new location the subroutine will return a value of zero to indicate a possible move. If two chessmen are moved to new locations on the playing field the subroutine will return a value of −1 to indicate a possible castle move. If one chessman is moved to a new location and a second chessman is lifted from the playing field the subroutine will return a value of 1 to indicate a castle move may be in progress and will turns "off" the ERROR and NO leds. If none of the above conditions exist on the playing field the subroutine returns a value of 2 and indicates an error condition by emitting a single double frequency tone (one time for any given error condition) and by turning "on" the ERROR leds. The location of the error is indicated with the MATRIX leds on the appropriate side of the board. The subroutine also turns "off" the NO leds.

The Advance Move Subroutine 236 determines if an advance move was initiated by a player (a move made while it's still ones opponent's turn to move) by determining during the first scanning operation of the board sensors 144, on the side to move next, whether any chessmen are missing from their sensors or whether any extra chessmen are covering sensors that should be vacant (i.e., any change in status of the sensors since the last move) and whether one or more of the following 3 conditions are currently present for the player to move next: one or more pawn tries, in check, or lost a chessman on his opponent's last move. If any of these 3 conditions occur the subroutine will activate the CONFIRM MOVE led 64 or 65, on the appropriate side of the board, to instruct the player, on that side, that his last move must be confirmed by moving the chessman back to its original location. The appropriate MATRIX leds are activated to identify the location of the advance move. If, accidently, more than one advance move was made then all of the chessmen must be moved back to their original positions. While the CONFIRM MOVE led 64 or 65 is activated all attempted moves, for the player to move next, are inhibited. When all of the moved chessmen have been re-positioned back to their original locations on the playing field, the CONFIRM MOVE led 64 or 65 is turned "off" and attempted moves are no longer inhibited.

The multi-move subroutine provides a feature to protect players against accidently completing moves they had not intended on making. This situation may occur under numerous circumstances. To illustrate this potential problem consider the situation that may occur when a player attempts to replace his king and rook back to their original locations following an illegal castle move. Normally the rook is moved back to its orginal location first followed by moving the king back to its original location. This procedure presents no problem. But, on the other hand, if the player moves the king back first, there will exist a period of time when the central processing unit 105 will think the player is attempting to make a rook move since the rook has not been replaced back to its original location. If, under this circumstance, the processor determines the rook move to be legal, then the player will have completed a move he had not intended on making. A similar problem can occur if for any reason two or more chessmen are removed from the playing field (accidently or on purpose) and in the process of replacing the chessmen back onto the playing field, the player accidently positions the chessmen in such a way that the last chessman is not at its original location, but at a location that constitutes a legal move. This would result in him completing a move he had not intended to make. To eliminate this potential problem the player will be required, under certain circumstances, to confirm attempted moves that result from this condition. A flag is set if any of the following 5 conditions occur: (The terminology "MISSING" below refers to a chessman missing from the playing field, while "NEW" refers to a new chessman on the playing field). [One "NEW" and two "MISSING"] or [two "NEW" and two "MISSING" if not a legal move] or [two "NEW" and one "MISSING"] or [three or more "NEW" and one or more "MISSING"] or [one or more "NEW" and three or more "MISSING"]. The flag is cleared if the following condition occurs: [Zero "NEW" and zero or one "MISSING"]. The CONFIRM MOVE led 64 or 65 and MATRIX leds (on the appropriate side of the board) will be activated and confirmation will be required if the following condition occurs: The flag, referred to above, is set and there is one "NEW" and one "MISSING" chessman on the playing field that does not constitute an erroneous move (i.e., the move would either by a legal or illegal move, but not an erronous move). Confirmation of the potential move is performed by lifting the chessman at the location defined by the MATRIX leds and replacing it back to its original location. (After the chessman is lifted the MATRIX leds will point at the original location).

Following the Multi-move Subroutine 238 a test 240 is performed to determine if a move was attempted. If no move was attempted the program branches back to the Memory Loading subroutine 216, otherwise the program falls through and executes the Single Move subroutine 242. The Single Move subroutine is only called when one chessman is moved to a new location on the playing field. (Scan Analysis subroutine 234 returned a value of zero). The subroutine 242 determines if the attempted move was a legal chess move as defined by the rules of chess. If the move is legal, the subroutine returns a value of zero to indicate a legal move and turns the ERROR (68 or 69) and NO (66 or 67) leds "off". If the move was determined to be illegal because the moved chessman attempted to jump over an opponent's chessman or the move resulted in the player placing his king in check then the subroutine returns a value of 1, emits a single beep tone (one for each illegal move) and activates the NO leds to indicate an illegal move. If the attempted move is determined to be an illegal move under any and all circumstances, then the subroutine returns a value of −1, emits a single double frequency tone (one for each error condition) and activates the ERROR leds to indicate the move is completely erronous. Moving a rook in a diagonal direction or moving a pawn backward would be examples of erroneous moves.

The Castle subroutine 244 is only called when two chessmen have been moved to new locations on the playing field. (Scan Analysis subroutine 234 returned a value of −1). The subroutine 244 determines if the attempted move was legal as defined by the rules of chess. If the move is legal, the subroutine returns a value of zero to indicate a legal castle move and turns "off"the ERROR and NO leds. If the attempted move is determined to be illegal because the king is moving through or into check then the subroutine returns a value of 1, emits a single beep tone (one time for each illegal move) and activates the NO leds. If the attempted move is determined to be illegal under any and all circumstances then the subroutine returns a value of −1, emits a single double frequency tone (one time for any given error condition) and activates the ERROR leds to indicate a completely erroneous move. Attempting to castle while one's own chesspiece is between the king and rook, attempting to castle while in check, or attempting to castle after already moving either the king or rook would be examples of erroneous moves. Following the Castle subroutine a test 246 is performed to determine if the attempted move was legal. If the move was illegal the program branches back to the Memory Loading subroutine 216, otherwise the program falls through and executes the Record subroutine 248. The Record subroutine maintains a to/from list in the data memory 106 for each legal move made for each game piece and is used by the Replay, Branch, and Reverse subroutines to define the moves made during a game. A special flag is stored in the to/from list to differentiate a castle move from a non-castle move.

If a chessman was captured on the last move the Captured Chessman Subroutine 250 announces that a capture occured by emitting a continuous double beep tone and indicates the type of chessman captured by activating the PIECE (40 and 41) or PAWN (37 and 39) CAPTURED leds on both sides of the board and indicates the location of the capture by activating the appropriate MATRIX leds. The subroutine waits until the captured chessman has been removed from the playing field and then turns "off" the PAWN or PIECE CAPTURED leds, the MATRIX leds, and the double beep tone.

The Pawn Promotion subroutines 252 converts pawns that have reached the 8th rank to queens. It performs this operation by changing the contents of the memory variable "TYPE OF PLAYER" from a pawn to a queen. In this way the Update subroutine 254 that follows the Pawn Promotion subroutine will update the data memory with a queen instead of a pawn. If at the beginning of the game the option to announce pawn promotions was selected, then the subroutine 252 will announce the promotion of all pawns by flashing a double P (P P) in the time displays 50 and 51 on the white side and 56 and 58 on the back side and by emitting a continuous beeping tone for approximately 3 seconds to indicate a pawn promotion has occured. It should be noted that the location (column) of the promotion is not announced, only the fact that a pawn promotion has occured. If, on the other hand, the option not to announce pawn promotions was selected at the beginning of the game, when no announcement will be made.

On each legal move the Update subroutine 254 updates the data memory 106 to correspond to the new positions of the chessmen on the playing fields. The Change Side subroutine 256 outputs a single audible beep to indicate that the last player to move has made a legal move. Also, the subroutine updates the WHITE and BLACK MOVE leds 62 and 63 respectively, to indicate which player is to move next and re-initializes memory variables to correspond to a new player moving next.

The Clock Interrupt routine 258 is initiated each half second by a timing signal 131, shown in FIG. 4, from the central processing unit 105. For timed games, the routine 258 updates the time clock of the player to move next by incrementing the appropriate memory variables that are associated with time measurements. For fixed length timed games the routine outputs the current time remaining for each player and for variable length timed games the current time remaining to complete 20 moves, the number of moves made and the rate of play in the appropriate displays 50 and 51 on the white side and 56 and 58 on the black side. For non-timed games the routine outputs the number of moves made by each player since the beginning of the game to displays 50 and 51 on the white side and 56 and 58 on the black side. Time warnings for variable and fixed length timed games are provided by the Clock Interrupt routine 258 to alert the players that the time remaining to make moves is approaching a critical period and that if immediate action is not taken loss of the game may occur to the player to move next. For fixed length timed games a warning is given when the time remaining, shown in the time displays 50 and 51 on the white side and displays 56 and 58 on the black side, for any player is equal to approximately 20 seconds. The warning consists in the MATRIX leds and time displays flashing on the side running out of time for a duration of approximately 3 seconds. The time warning is only given to the player running out of time to eliminate the detrimental use of the warning by his opponent. For variable length timed games a warning is given at a predetermined time as a function of the current value of the RATE display (display 50 on the white side and 56 on the black side) and the MOVES display (display 51 on the white side and 58 on the black side) as documented in Table 1 below.

TABLE 1

| WARNING GIVEN WHEN TIME REMAINING EQUALS | CONDITION (For player to move next) |
|---|---|
| 16 SEC | "MOVES" DISPLAY LESS THAN 20 |
| 19 SEC | "RATE" DISPLAY EQUALS −2 |
| 23 SEC | "RATE" DISPLAY EQUALS −3 |
| 27 SEC | "RATE" DISPLAY EQUALS −4 |
| 31 SEC | "RATE" DISPLAY EQUALS −5 |
| 35 SEC | "RATE" DISPLAY EQUALS −6 |
| 39 SEC | "RATE" DISPLAY EQUALS −7 |
| 43 SEC | "RATE" DISPLAY EQUALS −8 |
| 47 SEC | "RATE" DISPLAY EQUALS −9 |
| 51 SEC | "RATE" DISPLAY EQUALS −10 |

The actual warning procedure is identical to fixed length timed games with the MATRIX leds and time displays flashing for a duration of approximately 3 seconds.

If a pawn try exists the routine will perform the following operation: Until the player to move next has made 3 or more unsuccessfull attempts to capture an opponent's chessman with one or more of his pawns the routine will output to the pawn try displays 52 and 60 (on both sides of the board) either the exact number of pawn tries or the letter "P". The display format will depend upon the pawn try option selected at the beginning of the game. The routine will then turn the pawn try displays "on" and "off" each half second to indicate this condition. If 3 or more unsuccessfull attempts to capture are made, the routine will stop flashing the displays 52 and 60 and will keep the displays "on" continuously to indicate that the player to move next is not permitted to capture with any of his pawns on that move and that he must select an alternate move.

While this invention has been particularly shown and described with reference to a preferred embodiment thereof, it will be understood by those skilled in the art that the foregoing and other changes in form and details, especially covering particular alternatives, such as, the addition of aural announcements with a speech synthesizer chip, may be made therein without departing from the spirit and scope of the invention.

What is claimed is:

1. An electronic game having two chess-like boards wherein each board contains a playing field consisting of areas in a matrix, separated to conceal the moves made by each player from the other, having two sets of men positioned on each board, and further comprising:

a data memory;

means for detecting the position of each of the men, the improvement comprising:

means for initializing the positions of the men in said memory means for storing the detected positions in said memory sequentially as the game progresses;

means for analyzing the location of the men and comparing to previous locations, including:

means for determining and indicating whether attempted moves are legal according to established rules, and inhibiting the storage of positions resulting from illegal move attempts;

means for determining and indicating conditions of check, comprising:

means for determining and indicating the direction of check, wherein said direction of check includes at least one of horizontal, vertical, diagonal, or knight;

means for determining and indicating the player to move next;

means for determining and indicating the exact number of legal pawn moves that would result in the capture of opposing men, wherein the legality of the pawn moves are defined by the standard rules of chess; and means for controlling the sequence of operations performed by the electronic game.

2. The game of claim 1 further comprising second means for indicating pawn moves for indicating only that at least one pawn is in a position to capture opposing men; and manually operable means for selecting and causing activation of one of said means for indicating pawn moves.

3. The game of claim 1 further comprising means for determining and indicating pawn promotions; and selectable means for deactivating said pawn promotions indicating means to allow the players to select whether pawn promotions will or will not be announced during the course of the game.

4. The game of claim 1 wherein said means for determining and indicating conditions of diagonal check further includes means for determining and indicating whether the diagonal check is in a left or right diagonal direction, and means for determining and indicating whether the diagonal check is in a short or long diagonal direction; and selectable means for deactivating one of said diagonal direction indicating means to allow the players to select whether the indication of diagonal check will be said left or right diagonal direction or said short or long diagonal direction during the course of the game.

5. An electronic game having two chess-like boards wherein each board contains a playing field consisting of areas in a matrix, separated to conceal the moves made by each player from the other, having two sets of men positioned on each board, and further comprising:

a data memory;

means for detecting the position of each of the men on each board;

means for initializing the positions in said memory;

means for storing the detected positions in said memory sequentially as the game progresses, as each player takes his turn;

means for analyzing the location of the men and comparing the location to previous locations, including:

means for determining and indicating whether the attempted moves are legal according to established rules, and inhibiting the storage of positions resulting from illegal move attempts;

means for controlling the sequence of operations performed by the electronic game;

wherein said means for detecting comprises a plurality of sensor photocells located one in each board area on each board, said sensors being activated when ambient light strikes their surface, and deactivated when ambient light does not strike their surface, and wherein said sensors are mounted in said board areas in a manner to allow said ambient light to be blocked when said men are positioned over said sensors and not blocked when said men are not positioned over said sensors.

6. The game of claim 5 wherein said means for detecting comprises a plurality of sensor photocells, and further comprising means for controlling the sensitivity of said sensor photocells under different ambient light conditions, comprising:

at least one sampling photocell, one located on at least one of said boards;

photocell amplifier circuitry associated with said sensor photocells; and means for controlling the gain of said amplifier circuitry according to the output of said sampling photocell.

7. An electronic game having two chess-like boards wherein each board contains a playing field consisting of areas in a matrix, separated to conceal the moves made by each player from the other, having two sets of men positioned on each board, and further comprising:

a data memory;

means for detecting the position of each of the men on each board;

means for initializing the positions in said memory;

means for storing the detected positions in said memory sequentially as the game progresses, as each player takes his turn;

means for analyzing the location of the men and comparing the location to previous locations, comprising:

means for determining and indicating whether the attempted moves are legal according to established rules, and inhibiting the storage of positions resulting from illegal move attempts;

means for controlling the sequence of operations performed by the electronic game;

wherein said means for detecting comprises a plurality of sensor phototransistors located one in each board area on each board, said sensors being activated when ambient light strikes their surface, and de-activated when ambient light does not strike their surface, and wherein said sensors are mounted in said board areas in a manner to allow said ambient light to be blocked when said men are positioned over said sensors and not blocked when said men are not positioned over said sensors.

8. An electronic game having two chess-like boards wherein each board contains a playing field consisting of areas in a matrix, separated to conceal the moves made by each player from the other, having two sets of men positioned on each board, and further comprising:

a data memory;

means for detecting the position of each of the men on the boards;

means for storing the detected positions in said memory sequentially as the game progresses, as each player takes his turn;

means for analyzing the location of the men and comparing the location to previous locations, means for determining and indicating whether the attempted moves are legal according to established rules, and inhibiting the storage of positions resulting from illegal move attempts;

means for controlling the sequence of operations performed by the electronic game;

means for determining moves made by a player in advance of his turn during his opponent's turn and indicating advance moves; and means for inhibiting the advance move until it is the player's turn and then means for continuing to inhibit the advance move when said player has one or more pawns in a position to capture opposing men and/or when said player is in check and means for enabling advance moves which are not otherwise inhibited.

9. The game of claim 8 further including:

selectable means for manually entering arbitrary locations for each selected man into said memory; and means for permitting the players to select the arrangement of men to be used at the start of the game.

10. The game of claim 8 further comprising:

second enabling means for enabling play that had been inhibited by an advance move, said second enabling means designed to enable play when men of said player have been returned to their previous locations on said board areas, said locations being defined by said data memory, and means for indicating to said player that moves are no longer inhibited.

11. The game of claim 8 further comprising:

second enabling means for enabling play that had been inhibited by an advance move, wherein said second enabling means comprises a manual switch located on said board, and connected to said means for indicating so that when said switch is activated, the play is enabled.

12. An electronic game having two chess-like boards wherein each board contains a playing field consisting of areas in a matrix, separated to conceal the moves made by each player from the other, having two sets of men positioned on each board, and further comprising:

a data memory;

means for detecting the position of each of the men on each board, means for initializing the positions in said memory;

means for storing the detected positions in said memory sequentially as the game progresses, as each player takes his turn;

means for analyzing the location of the men and comparing the location to previous locations, comprising:

means for determining and indicating whether the attempted moves are legal according to established rules, and inhibiting the storage of positions resulting from illegal move attempts;

means for controlling the sequence of operations performed by the electronic game;

means for limiting the length of time allocated for completing a pre-specified number of moves in a pre-selected period of time, comprising:

means for determining and indicating to each player the time remaining to complete the pre-specified number of moves;

means for determining and indicating to each player the number of moves accumulated; and means for announcing time warnings to alert the players that the time remaining to make moves is approaching a critical period wherein said time warning is given at a predetermined time as a function of how far the player is behind in time so that the farther behind the player is, the earlier the warning is given.

13. An electronic game having two chess-like boards wherein each board contains a playing field consisting of areas in a matrix, separated to conceal the moves made by each player from the other, having two sets of men positioned on each board, and further comprising:

a data memory;

means for detecting the position of each of the men on each board;

means for initializing the positions in said memory;

means for storing the detected positions in said memory sequentially as the game progresses, as each player takes his turn;

means for analyzing the location of the men and comparing the location to previous locations, comprising:

means for determining and indicating whether the attempted moves are legal according to established rules, and inhibiting the storage of positions resulting from illigal move attempts;

means for controlling the sequence of operations performed by the electronic game;

means for limiting the length of time allocated for completing a pre-specified number of moves in a pre-selected period of time;

means for determining and indicating to each player the time remaining to complete the pre-specified number of moves;

means for determining and indicating to each player the number of moves accumulated;

means for determining and displaying to each player the rate each player is making moves as referenced to the pre-specified number of moves and the pre-selected period of time wherein said means for displaying produces, alternatively:

(a) a symbol displayed to a player to indicate to that player that he is making moves, on the average, fast enough for him to complete exactly the pre-specified number of moves in the pre-selected period of time; or (b) other symbols displayed to that player to indicate to that player that he is making moves, on the average, faster or slower than is required for him to make the pre-specified number of moves in the pre-selected period of time.

14. An electronic game having two chess-like boards wherein each board contains a playing field consisting of areas in a matrix, separated to conceal the moves made by each player from the other, having two sets of men positioned on each board, and further comprising:

a data memory;

means for detecting the position of each of the men on the boards;

means for storing the detected positions in said memory sequentially as the game progresses, as each player takes his turn;

means for analyzing the location of the men and comparing the location to previous locations, comprising:

means for determining and indicating whether the attempted moves are legal according to established rules, and inhibiting the storage of positions resulting from illegal move attempts;

means for controlling the sequence of operations performed by the electronic game;

display means;

means for sequentially reading out to said display means, in a reverse direction, the positional data stored in said memory that corresponds to the legal moves made during the course of the game;

means for selectively erasing the most recent data in said memory;

reverse means for allowing each player to take back at least one of his previous legal moves that had been made during the course of the game, wherein said reverse means further comprises at least one board switch located on at least one of said boards to enable said reverse means, said reverse means being enabled by activating at least one said board switch and error indicating means for indicating an error condition;

said display means actuated by said reverse means for instructing the player to move the man back to its previous position by indicating which man is to be moved back, said display means also including means for indicating the area to which the reverse moving man is to be placed whereby said reverse means reverses the sequence of play, one move at a time, to direct the return of the men on the boards to a previous condition;

said means for detecting being connected to said reverse means and said error means, wherein said error means includes means for indicating at least one of the following error conditions:

(a) when instructed by the display means to move the man back to its previous position, the wrong man is moved, or (b) the reverse moving man is moved to the wrong area;

said indicating means, if a man was captured on the previous legal move, further indicating the location and type of that man to replace back on said board; and said display means, if a pawn was promoted to a piece on the previous legal move, further indicating the location to exchange that piece for a pawn on said board.

15. An electronic game having two chess-like boards wherein each board contains a playing field consisting of areas in a matrix, separated to conceal the moves made by each player from the other, having two sets of men positioned on each board, and further comprising:

a data memory;

means for detecting the position of each of the men on each board;

means for storing the detected positions in said memory sequentially as the game progresses, as each player takes his turn;

means for analyzing the location of the men and comparing the location to previous locations, comprising:

means for determining and indicating whether the attempted moves are legal according to established rules, and inhibiting the storage of positions resulting from illegal move attempts;

means for controlling the sequence of operations performed by the electronic game to completion;

display means;

means for sequentially reading out to said display means the positional data stored in said memory that corresponds to the legal moves made during the course of the game;

replay means for allowing the previous game to be automatically replayed wherein said replay means further comprises at least one board switch located on at least one of said boards to enable said replay means, said replay means being enabled by activating at least one of said board replay switch, and error indicating means for indicating an error condition, said display means corresponding to each area on each board to selectively indicate a particular matrix area, said data memory and said means for controlling being connected to each other by at least one said board replay switch so that when said replay switch is actuated, the previous game is sequentially replayed by said display indicating the area from which a man is to be moved and indicating the area to which the man is to be moved, said means for detecting being connected to said replay means and said error means, wherein said error means includes means for indicating at least one of the following error conditions:

(a) a man is moved from the wrong area, or (b) a man is moved to the wrong area;

said means sequentially actuating said area displays to continue to instruct the player to sequentially move the men in accordance with the actual moves made in the previous game.

16. The game of claim 15 wherein said replay means causes said replay of the game to take place entirely on one board, thereby allowing the players of the game during the replay of the game to view the two opposing forces on the same playing field.

17. An electronic game having two chess-like boards wherein each board contains a playing field consisting of areas in a matrix, separated to conceal the moves made by each player from the other, having two sets of men positioned on each board, and further comprising:

a data memory prior to game play, means for detecting the position of each of the men on each board;

means for storing the detected positions in said memory sequentially as the game progresses, as each player takes his turn;

means for analyzing the location of the men and comparing the location to previous locations, comprising:

means for determining and indicating whether the attempted moves by players are legal according to established rules, and inhibiting the storage of positions resulting from illegal move attempts;

means for controlling the sequence of operations performed by the electronic game;

means for selectively erasing positional data from memory, said means for selectively erasing comprising a delete switch on at least one of said boards, said delete switch being connected to said means for detecting and said data memory so that when said delete switch is actuated said positional data is erased from said data memory at locations in said data memory that correspond to men removed from said boards so that the memory is updated to permit individual men to be deleted from the playing boards.

18. An electronic game having two chess-like boards wherein each board contains a playing field consisting of areas in a matrix, separated to conceal the moves made by each player from the other, having two sets of men positioned on each board, and further comprising:

a data memory;

means for detecting the position of each of the men on each board;

means for initializing the positions in said memory;

means for storing the detected positions in said memory sequentially as the game progresses, as each player takes his turn;

means for analyzing the location of the men and comparing the location to previous locations, including;

means for determining and indicating whether the attempted moves are legal according to established rules, and inhibiting the storage of positions resulting from illegal move attempts;

means for controlling the sequence of operations performed by the electronic game;

means for determining and indicating multiple move conditions comprising:

(a) logic means, said logic means being connected to said means for detecting so that said logic means is set true when two or more men are missing from their original locations on the board areas of the player to move next and set false when less than two men are missing from their original locations on said board areas, and when there are no men on locations on said board areas that should be vacant, and (b) means for inhibiting a move when an intentional or unintentional attempt to move one man is made on said board areas, of said logic means is set true, including means for indicating such inhibit condition.

19. The game of claim 18 including:

means for again enabling registration of movement of men when the man subject to an intentional or unintentional attempt to move is back in its position prior to the intentional or unintentional attempt to move.

20. An electronic game having two chess-like boards wherein each board contains a playing field consisting of areas in a matrix, separated to conceal the moves made by each player from the other, having two sets of men positioned on each board, and further comprising:

a data memory;

means for detecting the position of each of the men on each board by scanning all of said areas, and means for storing all such detected positions in said memory.

means for initializing the positions of said men in said memory prior to game play, one particular type of man at a time as each type of man is initially placed on said board, comprising:

(a) switch means for identifying each of said particular type of men after said type has been placed initially on said board; and (b) means for actuating said means for detecting so that said initial positions and type of each of the men is stored in said memory, said means for detecting including means for determining the presence of each new man in a previously unoccupied location;

means for storing the detected positions in said memory sequentially as the game progresses, as each player takes his turn;

means for analyzing the location of the men and comparing the location to previous locations, comprising:

means for determining and indicating whether the attempted moves are legal according to established rules, and inhibiting the storage of positions resulting from illegal move attempts;

means for controlling the sequence of operations performed by the electronic game. a

21. An electronic game having two chess-like boards wherein each board contains a playing field consisting of areas in a matrix, separated to conceal the moves made by each player from the other, having two sets of men positioned on each board, and further comprising:

a data memory;

means for detecting the position of each of the men on each board;

means for initializing the positions in said memory;

means for storing the detected positions in said memory sequentially as the game progresses, as each player takes his turn;

means for analyzing the location of the men and comparing the location to previous locations, comprising:

means for determining and indicating whether the attempted moves are legal according to established rules, and inhibiting the storage of positions resulting from illegal move attempts;

means for controlling the sequence of operations performed by the electronic game;

means for determining and indicating conditions of check, comprising:

means for determining and indicating the direction of check, wherein said check direction includes at least one of left diagonal or right diagonal.

22. The game of claim 21 further including means for determining and indicating whether the diagonal check is in a short or long diagonal direction; and selectable means for deactivating one of said diagonal direction indicating means to allow the players to select whether the indication of diagonal check will be said left or right diagonal direction or said short or long diagonal direction during the course of the game.

23. An electronic game having two chess-like boards wherein each board contains a playing field consisting of areas in a matrix, separated to conceal the moves made by each player from the other, having two sets of men positioned on each board, and further comprising:

a data memory;

means for detecting the position of each of the men on each board;

means for initializing the positions in said memory;

means for storing the detected positions in said memory sequentially as the game progresses, as each player takes his turn;

means for analyzing the location of the men and comparing the location to previous locations, comprising:

means for determining and indicating whether the attempted moves are legal according to established rules, and inhibiting the storage of positions resulting from illegal move attempts;

means for controlling the sequence of operations performed by the electronic game;

means for determining and indicating conditions of check, comprising:

means for determining and indicating the direction of check, wherein said check direction includes at least one of horizontal, vertical, diagonal, or knight; and selectable means for deactivating said pawn promotions indicating means to allow the players to select whether pawn promotions will or will not be announced during the course of the game.

24. The game of claim 23 wherein said pawn promotion means further includes means for automatically, without player intervention, promoting pawns to only queens during the course of the game.

* * * * *

UNITED STATES PATENT AND TRADEMARK OFFICE

CERTIFICATE OF CORRECTION

PATENT NO. 4,541,633

DATED :September 17, 1985

INVENTOR(S) :Leston L. Newbill

It is certified that error appears in the above-identified patent and that said Letters Patent is hereby corrected as shown below:

Column 1, line 55, "reguiring" should read -- requiring --.

Column 7, line 48, "switche" should read -- switch --.

Column 9, line 28,"(RELAY)" should read -- (REPLAY) -- .

Column 11, line 42, before ",L,H" insert -- --.

Column 20, line 27, "when" should read -- then --.

Column 23, line 10, delete "one", second occurrence.

Column 24, line 40, "board," should read -- board; --.

Column 27, line 33, delete "prior to game play," and substitute -- ; --.

Column 27, line 50, after "memory" insert -- prior to game play-.

Column 28, line 26, "of" should read -- if --.

Column 29, line 2, after "game." cancel "a".

UNITED STATES PATENT AND TRADEMARK OFFICE

CERTIFICATE OF CORRECTION

PATENT NO. : 4,541,633

DATED : September 17, 1985

INVENTOR(S) : Leston L. Newbill

It is certified that error appears in the above-identified patent and that said Letters Patent is hereby corrected as shown below:

Column 30, line 29, after "knight;" but before "and" insert -- means for determining and indicating pawn promotions; --.

Signed and Sealed this

*Twelfth* Day of *August 1986*

[SEAL]

*Attest:*

DONALD J. QUIGG

*Attesting Officer*

*Commissioner of Patents and Trademarks*